US012313079B2

(12) United States Patent
Kanzaka et al.

(10) Patent No.: US 12,313,079 B2
(45) Date of Patent: May 27, 2025

(54) IMPELLER OF CENTRIFUGAL COMPRESSOR AND CENTRIFUGAL COMPRESSOR

(71) Applicant: MITSUBISHI HEAVY INDUSTRIES ENGINE & TURBOCHARGER, LTD., Sagamihara (JP)

(72) Inventors: Tadashi Kanzaka, Tokyo (JP); Kenichiro Iwakiri, Tokyo (JP); Yutaka Fujita, Tokyo (JP); Hironori Honda, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 18/289,405

(22) PCT Filed: Jun. 10, 2021

(86) PCT No.: PCT/JP2021/022206

§ 371 (c)(1),
(2) Date: Nov. 3, 2023

(87) PCT Pub. No.: WO2022/259490

PCT Pub. Date: Dec. 15, 2022

(65) Prior Publication Data

US 2024/0240647 A1 Jul. 18, 2024

(51) Int. Cl.
*F04D 29/22* (2006.01)
*B23C 3/18* (2006.01)
(Continued)

(52) U.S. Cl.
CPC ..... *F04D 29/30* (2013.01); *F04D 29/284* (2013.01); *F04D 29/324* (2013.01); *F04D 29/4226* (2013.01)

(58) Field of Classification Search
CPC ..... F04D 29/284; F04D 29/324; F04D 29/30; B23C 3/18
See application file for complete search history.

(56) References Cited

U.S. PATENT DOCUMENTS 5,595,473 A 1/1997 Nagaoka et al.
2005/0169750 A1 8/2005 Kim et al.
(Continued)

FOREIGN PATENT DOCUMENTS

CN 111931304 A * 11/2020 ..... F04D 29/2216
JP 7-167099 A 7/1995
(Continued)

OTHER PUBLICATIONS

English JP2013213504 by PE2E May 7, 2024.*
(Continued)

*Primary Examiner* — Deming Wan
(74) *Attorney, Agent, or Firm* — BIRCH, STEWART, KOLASCH & BIRCH, LLP

(57) ABSTRACT

An impeller (10) of a centrifugal compressor (4) is provided with a hub (14) and a plurality of blades (16) provided at intervals in a circumferential direction of the impeller (10) on an outer peripheral surface of the hub (14). In a meridian plane shape of the blades (16), as the coordinate axes with the origin at a tip end (30*s*) of a trailing edge (30) of the blades (16), an X-axis connecting the tip end (30*s*) and a base end (30*h*) of the trailing edge (30) and a Y-axis orthogonal to the X-axis are defined. When a direction from the tip end (30*s*) toward the base end (30*h*) along the X-axis is defined as a positive direction of the X-axis and a direction toward the outside in a radial direction of the impeller (10) along the Y-axis is defined as a positive direction of the Y-axis, the trailing edge (30) in the meridian plane shape of the blades (16) includes a first decrease section (30*a*) extending so that the Y-coordinate decreases as the X-coor-
(Continued)

dinate increases, and a first increase section (30*b*) positioned between the first decrease section (30*a*) and the base end (30*h*) and extending so that the Y-coordinate increases as the X-coordinate increases.

15 Claims, 17 Drawing Sheets

(51) Int. Cl.

| | |
|---|---|
| ***F04D 29/28*** | (2006.01) |
| ***F04D 29/30*** | (2006.01) |
| ***F04D 29/32*** | (2006.01) |
| ***F04D 29/42*** | (2006.01) |

(56) References Cited

U.S. PATENT DOCUMENTS

| | | | | |
|---|---|---|---|---|
| 2005/0254954 | A1* | 11/2005 | Higashimori | F04D 29/284 416/223 R |
| 2008/0229742 | A1 | 9/2008 | Renaud et al. | |
| 2010/0322781 | A1 | 12/2010 | Heyes et al. | |
| 2012/0263599 | A1 | 10/2012 | Sugimura et al. | |
| 2017/0350410 | A1* | 12/2017 | Saito | F04D 29/30 |

FOREIGN PATENT DOCUMENTS

| | | | | |
|---|---|---|---|---|
| JP | 2009-221984 | A | 10/2009 | |
| JP | 2011-512479 | A | 4/2011 | |
| JP | 2013-96378 | A | 5/2013 | |
| JP | 5730649 | B2 | 6/2015 | |
| JP | 2015-194091 | A | 11/2015 | |
| JP | 2016-109092 | A | 6/2016 | |
| JP | 2020-79567 | A | 5/2020 | |
| JP | 2013213504 | A * | 10/2023 | F04D 29/284 |
| WO | WO 2007-022648 | A1 | 3/2007 | |

OTHER PUBLICATIONS

English CN 111931304 by PE2E Sep. 27, 2024.*

International Preliminary Report on Patentability and Written Opinion of the International Searching Authority for International Application No. PCT/JP2021/022206, dated Dec. 21, 2023, with an English translation.

International Search Report and Written Opinion of the International Searching Authority for International Application No. PCT/JP2021/022206, dated Aug. 17, 2021.

* cited by examiner

IMPELLER OF CENTRIFUGAL COMPRESSOR AND CENTRIFUGAL COMPRESSOR

TECHNICAL FIELD

The present disclosure relates to an impeller of a centrifugal compressor, and a centrifugal compressor.

BACKGROUND ART

In PTL 1, it is described that in order to promote a higher pressure ratio of a centrifugal compressor while maintaining the durability of an impeller of the centrifugal compressor, a protrusion portion that protrudes radially outward with respect to a maximum diameter portion of a compressor disk is provided in a predetermined range of a trailing edge of a blade of the impeller.

CITATION LIST

Patent Literature

[PTL 1] Japanese Unexamined Patent Application Publication No. 2015-194091

SUMMARY OF INVENTION

Technical Problem

In a blade of an impeller of a typical centrifugal compressor of the related art, a trailing edge of the blade is formed parallel to an axial direction, and in such a configuration, as shown in FIG. 12, boundary layers develop on a downstream side of the impeller in the vicinity of a wall surface on a shroud wall portion side facing a tip end of the blade and in the vicinity of a wall surface on a hub wall portion side. Therefore, as shown in FIG. 13, the radial flow speed in the vicinity of the wall surface on the shroud wall portion side and the radial flow speed in the vicinity of the wall surface on the hub wall portion side become slower than the radial flow speed in an intermediate span region between the shroud wall portion and the hub wall portion. Therefore, a risk of an increase in loss due to separation of a flow in the vicinity of the wall surface on the shroud wall portion side and in the vicinity of the wall surface on the hub wall portion side, and a risk of a reduction in operating range due to a stall easily occur.

For example, in a case where a stall occurs in the vicinity of the wall surface on the shroud wall portion side, a flow is biased toward the hub wall portion side, and in a case where a stall occurs in the vicinity of the wall surface on the hub wall portion side, a flow is biased toward the shroud wall portion side. In any case, a decrease in performance in a diffuser and destabilization of a flow in the centrifugal compressor occur, resulting in a decrease in the efficiency of the centrifugal compressor.

Further, in the configuration described in PTL 1, although an increase in the centrifugal stress of a compressor disk can be suppressed compared to a case where the outer diameter of the impeller is uniformly expanded from a base end to a tip end of the trailing edge of the blade, bias of a flow in a blade span direction in the diffuser cannot be suppressed, so that there is a problem in terms of the efficiency of the centrifugal compressor.

In view of the above circumstances, an object of at least one embodiment of the present disclosure is to provide an impeller of a centrifugal compressor, in which it is possible to realize a highly efficient centrifugal compressor, and a centrifugal compressor that includes the impeller.

Solution to Problem

In order to achieve the above object, an impeller of a centrifugal compressor according to at least one embodiment of the present disclosure includes:

- a hub; and
- a plurality of blades provided at intervals in a circumferential direction of the impeller on an outer peripheral surface of the hub,
- in which, in a meridian plane shape of the blade, when an X-axis connecting a tip end and a base end of a trailing edge and a Y-axis orthogonal to the X-axis are defined as coordinate axes with the tip end of the trailing edge as an origin, a direction from the tip end toward the base end along the X-axis is defined as a positive direction of the X-axis, and a direction toward an outside in a radial direction of the impeller along the Y-axis is defined as a positive direction of the Y-axis,
- the trailing edge in the meridian plane shape of the blade includes
- a first decrease section that extends such that a Y-coordinate decreases as an X-coordinate increases, and
- a first increase section that is located between the first decrease section and the base end and that extends such that a Y-coordinate increases as an X-coordinate increases.

In order to achieve the above object, a centrifugal compressor according to at least one embodiment of the present disclosure includes:

- the impeller of a centrifugal compressor described above; and
- a casing that accommodates the impeller.

Advantageous Effects of Invention

According to at least one embodiment of the present disclosure, there are provided an impeller of a centrifugal compressor, in which it is possible to realize a highly efficient centrifugal compressor, and a centrifugal compressor that includes the impeller.

DESCRIPTION OF EMBODIMENTS

Figure 1:
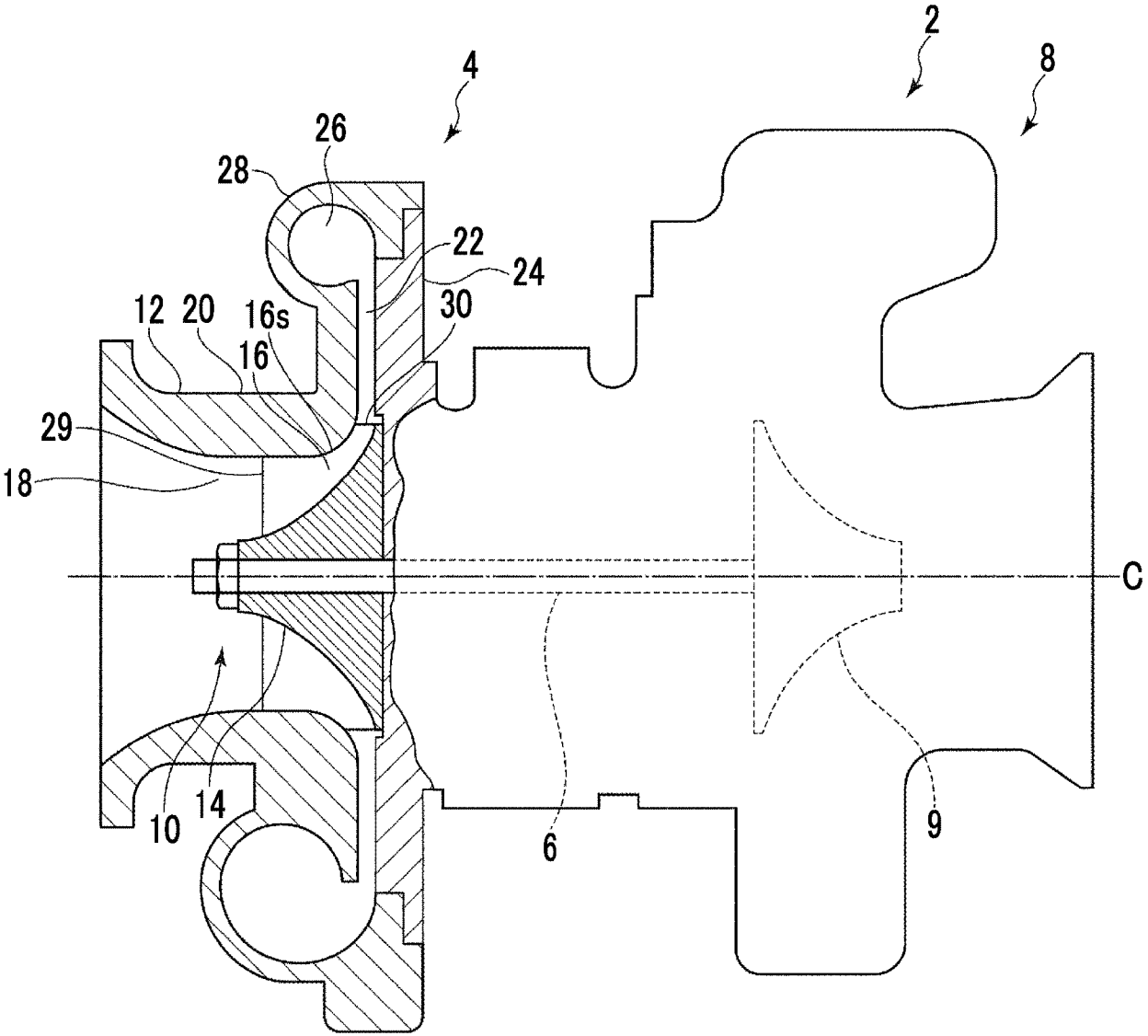
FIG. 1 is a partial sectional view of a turbocharger 2 according to an embodiment, and shows a schematic cross section of a centrifugal compressor 4 of the turbocharger 2 along an axis line direction of a rotary shaft 6.

Hereinafter, some embodiments of the present disclosure will be described with reference to the accompanying drawings. However, the dimensions, materials, shapes, relative dispositions, and the like of components described as embodiments or shown in the drawings are not intended to limit the scope of the invention and are merely illustrative examples.

For example, an expression indicating relative disposition or absolute disposition, such as "in a direction", "along a direction", "parallel", "orthogonal", "center", "concentric", or "coaxial", not only strictly represents such disposition, but also represents a state of being relatively displaced with a tolerance, or an angle or a distance to the extent that the same function can be obtained.

For example, expressions such as "identical", "equal", and "homogeneous", which indicate that things are in the same state, not only represent a state of being strictly equal, but also represent a state in which there is a tolerance, or a difference to the extent that the same function can be obtained.

For example, an expression indicating a shape such s a square shape or a cylindrical shape not only represents a shape such as a square shape or a cylindrical shape in a geometrically strict sense, but also represents a shape that includes concave and convex portions, chamfered portions, or the like to the extent that the same effects can be obtained.

Meanwhile, an expression such as "comprising", "possessing", "provided with", "including", or "having" one component is not an exclusive expression excluding the presence of other components.

FIG. 1 is a partial sectional view of a turbocharger 2 according to an embodiment, and shows a schematic cross section of a centrifugal compressor 4 of the turbocharger 2 along an axis line direction of a rotary shaft 6.

As shown in FIG. 1, the turbocharger 2 includes the centrifugal compressor 4 and a turbine 8 connected to the centrifugal compressor 4 through the rotary shaft 6. The centrifugal compressor 4 includes an impeller 10 and a casing 12 that accommodates the impeller 10.

In the following, an axial direction of the impeller 10 (the axis line direction of the rotary shaft 6) shall be simply referred to as an "axial direction", a radial direction of the impeller 10 (the radial direction of the rotary shaft 6) shall be simply referred to as a "radial direction", and a circumferential direction of the impeller 10 (the circumferential direction of the rotary shaft 6) shall be simply referred to as a circumferential direction.

The impeller 10 includes a hub 14 fixed to the rotary shaft 6, and a plurality of blades 16 provided at intervals in the circumferential direction on an outer peripheral surface of the hub 14. The impeller 10 is connected to a turbine wheel 9 of the turbine 8 through the rotary shaft 6, and the impeller 10 and the turbine wheel 9 are configured to rotate in an integrated manner. The rotary shaft 6 is rotatably supported by bearings (not shown).

The casing 12 includes a shroud wall portion 20 having a tubular shape, which surrounds the impeller 10 in the circumferential direction and forms an air flow path 18 therein, a hub wall portion 24 that faces a part of the shroud wall portion 20 outside the impeller 10 in the radial direction to form a diffuser flow path 22 between itself and the shroud wall portion 20, and a scroll part 28 that forms a scroll-shaped scroll path 26 connected to an outlet of the diffuser flow path 22. The shroud wall portion 20 is configured to face a tip end 16*s* of the blade 16, which connects a leading edge 29 of the blade 16 and a trailing edge 30 of the blade 16.

Figure 2A:
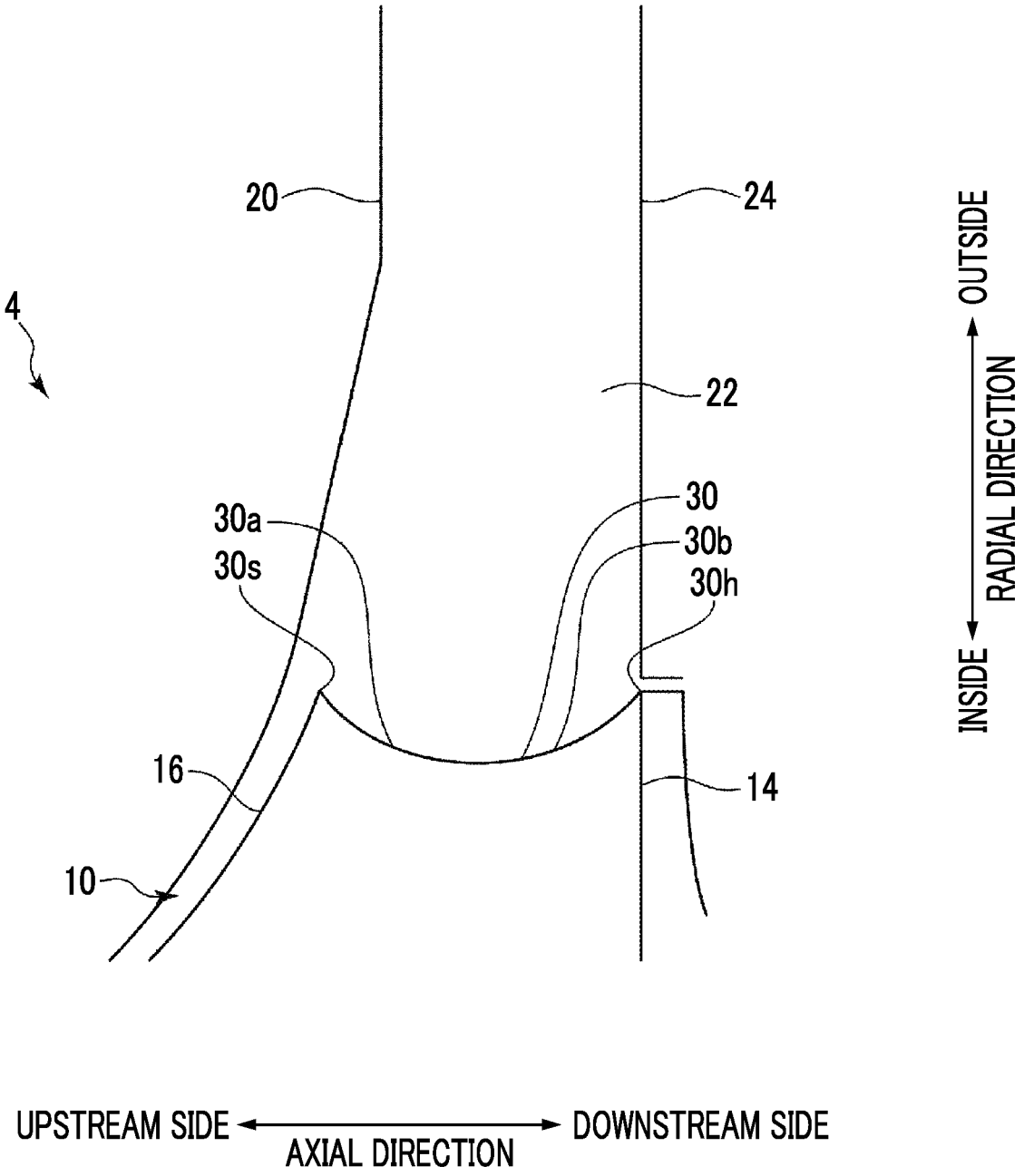
FIG. 2A is a meridian plane diagram showing an example of a meridian plane shape of a blade 16 with respect to a trailing edge 30 of the blade 16 of an impeller 10 in the turbocharger 2 shown in FIG. 1, and shows the vicinity of an outlet of the impeller 10 in the centrifugal compressor 4 of the turbocharger 2 in an enlarged manner.
Figure 2B:
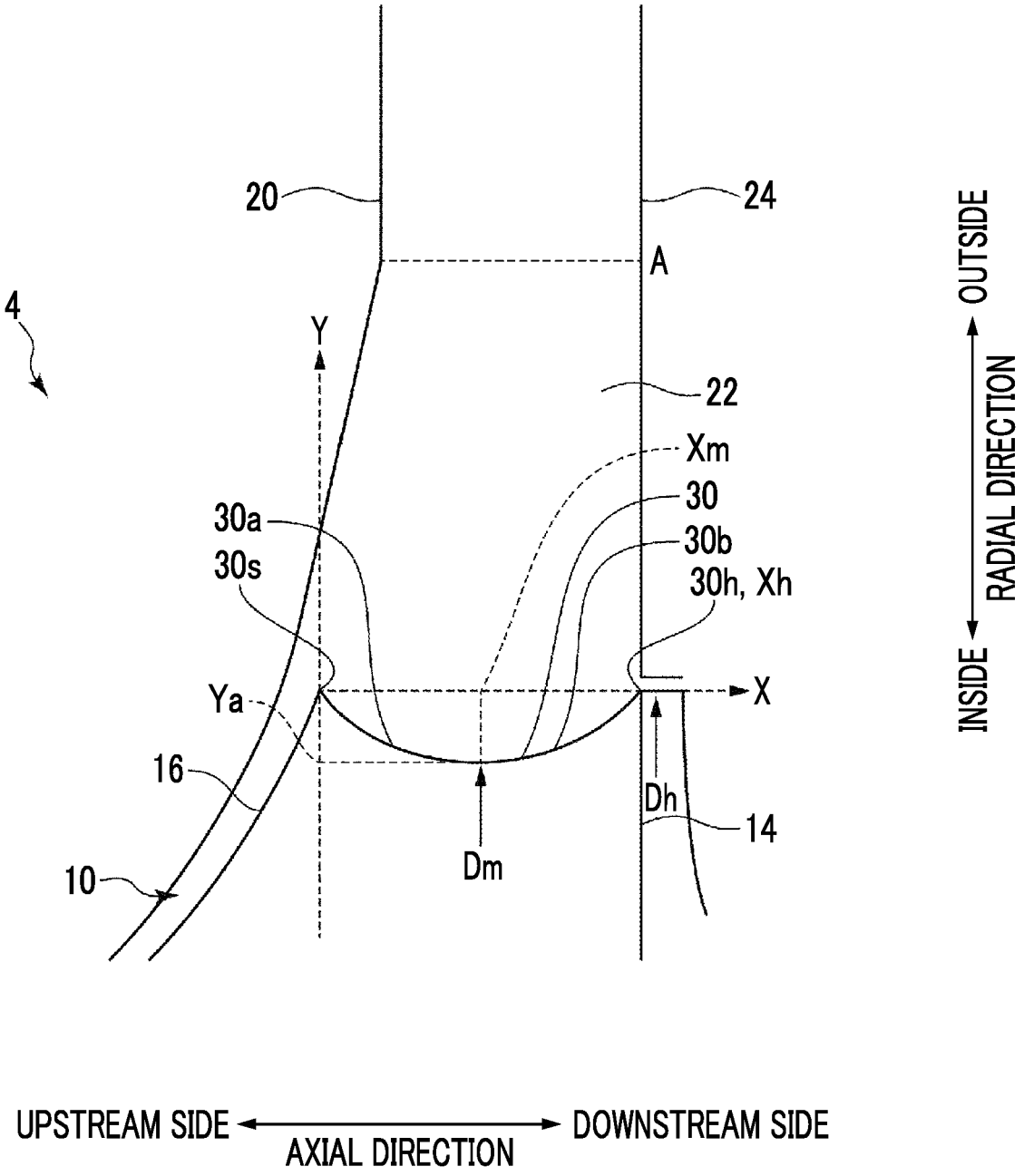
FIG. 2B is a diagram in which as coordinate axes, an X-axis and a Y-axis are shown in the configuration shown in FIG. 2A.

FIG. 2A is a meridian plane diagram schematically showing an example of the configuration of a portion in the vicinity of an outlet of the impeller 10 in the centrifugal compressor 4 of the turbocharger 2 shown in FIG. 1, and shows a part of the meridian plane shape of the blade 16 of the impeller 10. FIG. 2B is a diagram in which coordinate axes and the like are added to the meridian plane diagram shown in FIG. 2A. The meridian plane shape of the blade 16 refers to the shape of a projected image of the blade 16 projected onto the meridian plane of the impeller 10 in a rotation direction. Further, the meridian plane refers to a cross section that includes a rotational axis line C (refer to FIG. 1) of the impeller 10.

Here, as shown in FIG. 2B, in this specification, in the meridian plane shape of the blade 16, an X-axis connecting a tip end 30*s* and a base end 30*ho* trailing edge 30 and a Y-axis orthogonal to the X-axis are defined as coordinate axes with the tip end 30*s* of the trailing edge 30 of the blade 16 as the origin, the direction from the tip end 30*s* toward the base end 30*h* along the X-axis is defined as a positive direction of the X-axis, and a direction that is directed to the outside in the radial direction along the Y-axis is defined as a positive direction of the Y-axis. The tip end 30*s* of the trailing edge 30 of the blade 16 means the end of the trailing edge 30 on the shroud wall portion 20 side, and the base end 30*h* of the trailing edge 30 of the blade 16 means the end of the trailing edge 30 on the hub 14 side.

As shown in FIG. 2B, in the meridian plane shape of the blade 16, the trailing edge 30 of the blade 16 includes a first decrease section 30*a* that extends such that a Y-coordinate decreases as an X-coordinate increases, and a first increase section 30*b* that is located between the first decrease section 30*a* and the base end 30*h* and that extends such that a Y-coordinate increases as an X-coordinate increases. The first decrease section 30*a* extends in the negative direction of the Y-axis toward the positive direction of the X-axis. The first increase section 30*b* extends in the positive direction of the Y-axis toward the positive direction of the X-axis.

In the example shown in FIG. 2B, the first decrease section 30*a* and the first increase section 30*b* are adjacent to each other, one end of the first decrease section 30*a* is the tip end 30*s* of the trailing edge 30, the other end of the first decrease section 30*a* is connected to one end of the first increase section 30*b*, and the other end of the first increase section 30*b* is the base end 30*h* of the trailing edge 30. Further, in the meridian plane shape of the blade 16, the trailing edge 30 of the blade 16 has a concave shape that is concave inward in the radial direction with respect to the X-axis. In the XY coordinate system shown in FIG. 2B, the trailing edge 30 of the blade 16 is formed in a curved line shape that is convex downward. That is, in the XY coordinate system shown in FIG. 2B, each of the first decrease section 30*a* and the first increase section 30*b* is formed in a curved line shape that is convex downward.

Further, in the example shown in FIG. 2B, a minimum value Dm of the radial distance to the rotational axis line C (refer to FIG. 1) of the impeller 10 in the first decrease section 30*a* and the first increase section 30*b* (the smaller value out of the minimum value of the radial distance between the first decrease section 30*a* and the rotational axis line C and the minimum value of the radial distance between the first increase section 30*b* and the rotational axis line C) is smaller than a distance Dh between the base end 30*h* of the trailing edge 30 and the rotational axis line C. Further, in the illustrated example, the minimum value Dm of the distance between the first decrease section 30*a* and the rotational axis line C in the radial direction corresponds to the minimum value of the distance between the first increase section 30*b* and the rotational axis line C in the radial direction, and corresponds to the minimum value of the distance between the trailing edge 30 and the rotational axis line C in the radial direction. The distance Dh between the base end 30*h* and the rotational axis line C corresponds to the maximum value of the outer diameter of the hub 14.

Further, in the example shown in FIG. 2B, when an X-coordinate of the base end 30*h* of the trailing edge 30 is Xh, and an X-coordinate at which the distance to the rotational axis line C in the first decrease section 30*a* and the first increase section 30*b* becomes the minimum distance (in the illustrated example, an X-coordinate of the boundary between the first decrease section 30*a* and the first increase section 30*b*) is Xm, a relationship $0.2 \leq Xm/Xh \leq 0.8$ is satisfied.

Further, in the example shown in FIG. 2B, a minimum value Ya of the Y-coordinate of the first decrease section 30*a* has a negative value. Further, the Y-coordinate of the trailing edge 30 is 0 at each of the tip end 30*s* and the base end 30*h* of the trailing edge 30, and has a negative value in the range between the tip end 30*s* and the base end 30*h*.

Here, the effects exhibited by the embodiment shown in FIGS. 2A and 2B will be described.

Figure 3:
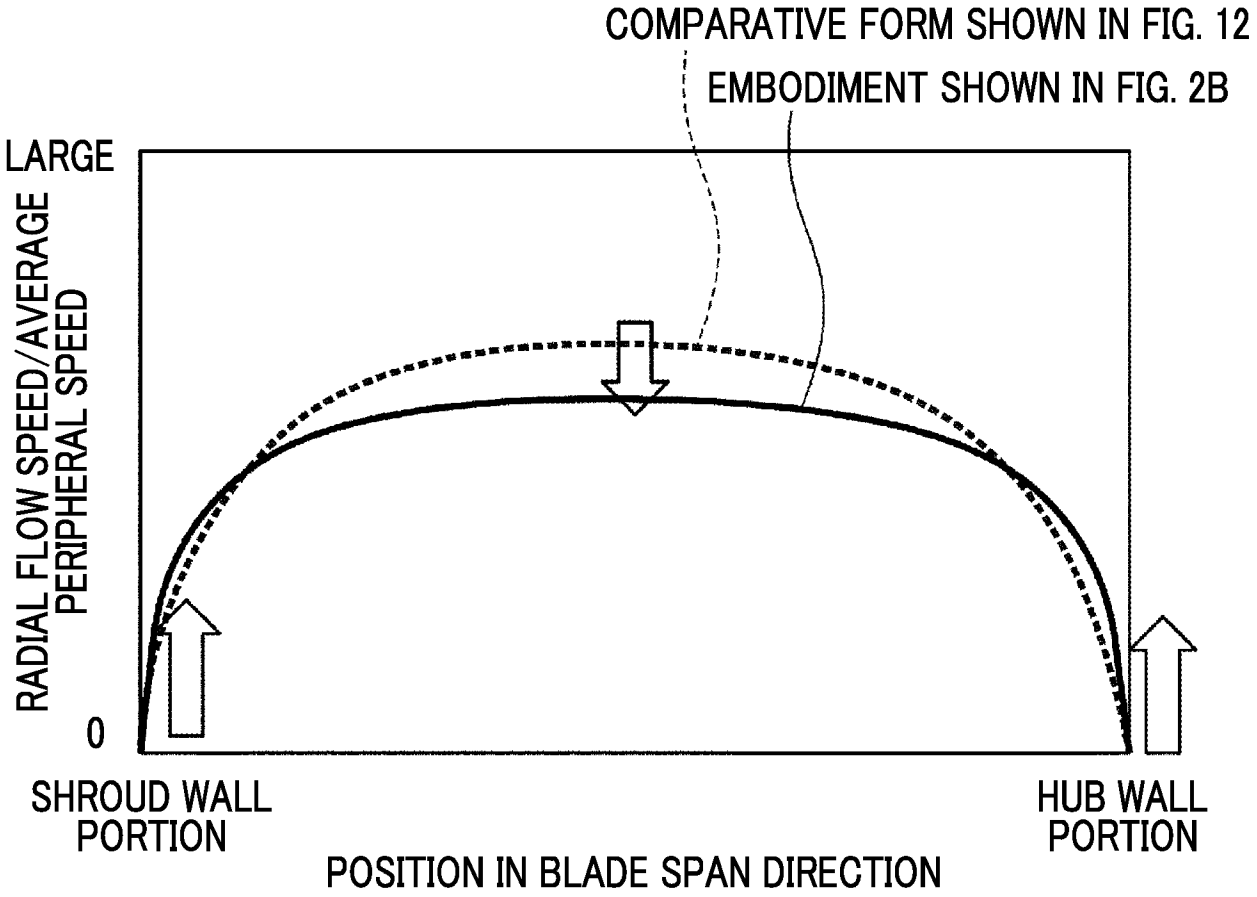
FIG. 3 is a diagram showing the radial flow speed distribution at the position of an evaluation cross section A in the embodiment shown in FIGS. 2A and 2B and the radial flow speed distribution at the position of the evaluation cross section A in a comparative form shown in FIG. 12.
Figure 12:
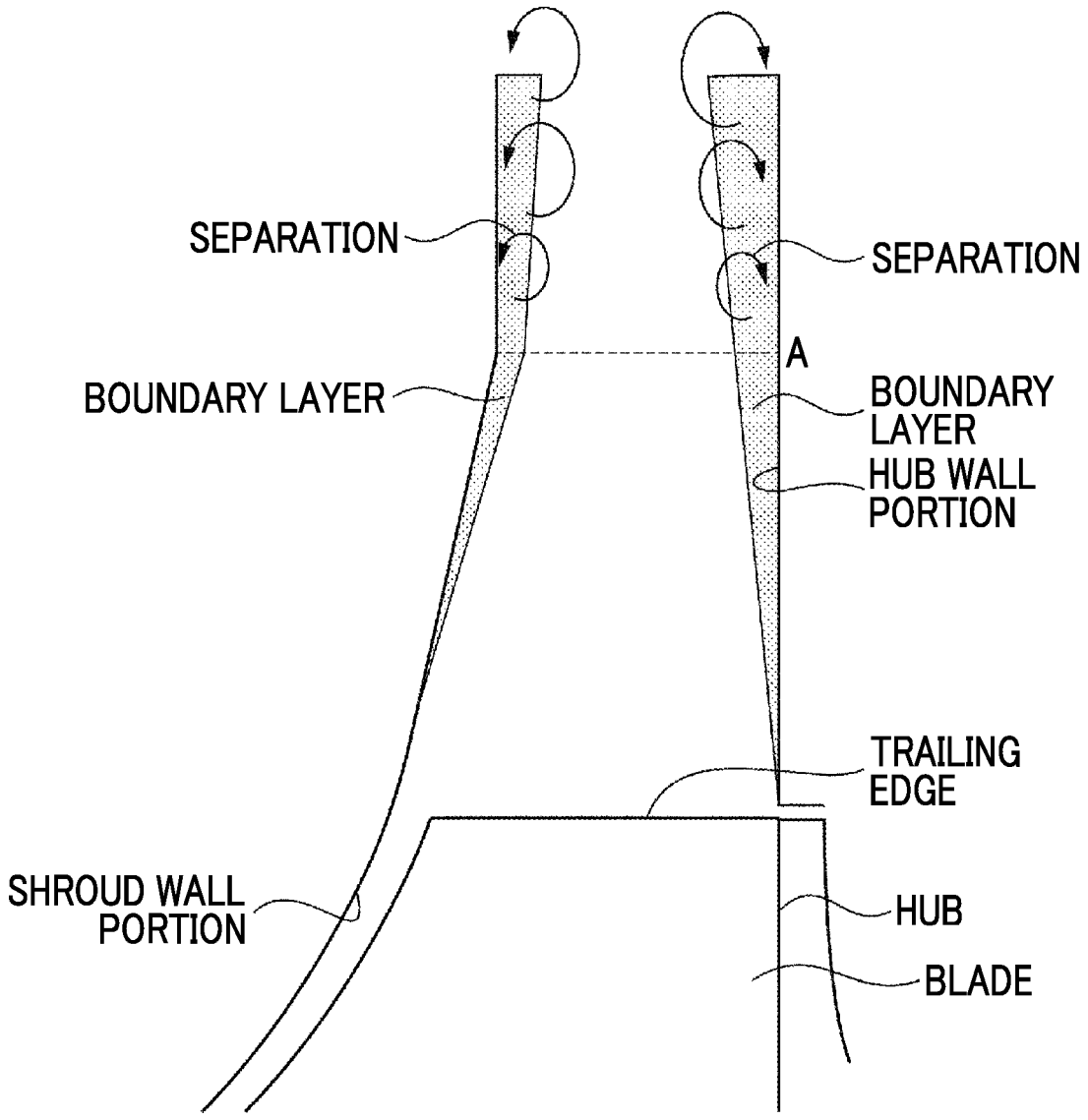
FIG. 12 is a meridian plane diagram showing the vicinity of an outlet of an impeller in a centrifugal compressor according to the comparative form, and is a diagram showing an aspect of development of a boundary layer on a downstream side of the impeller.
Figure 13:
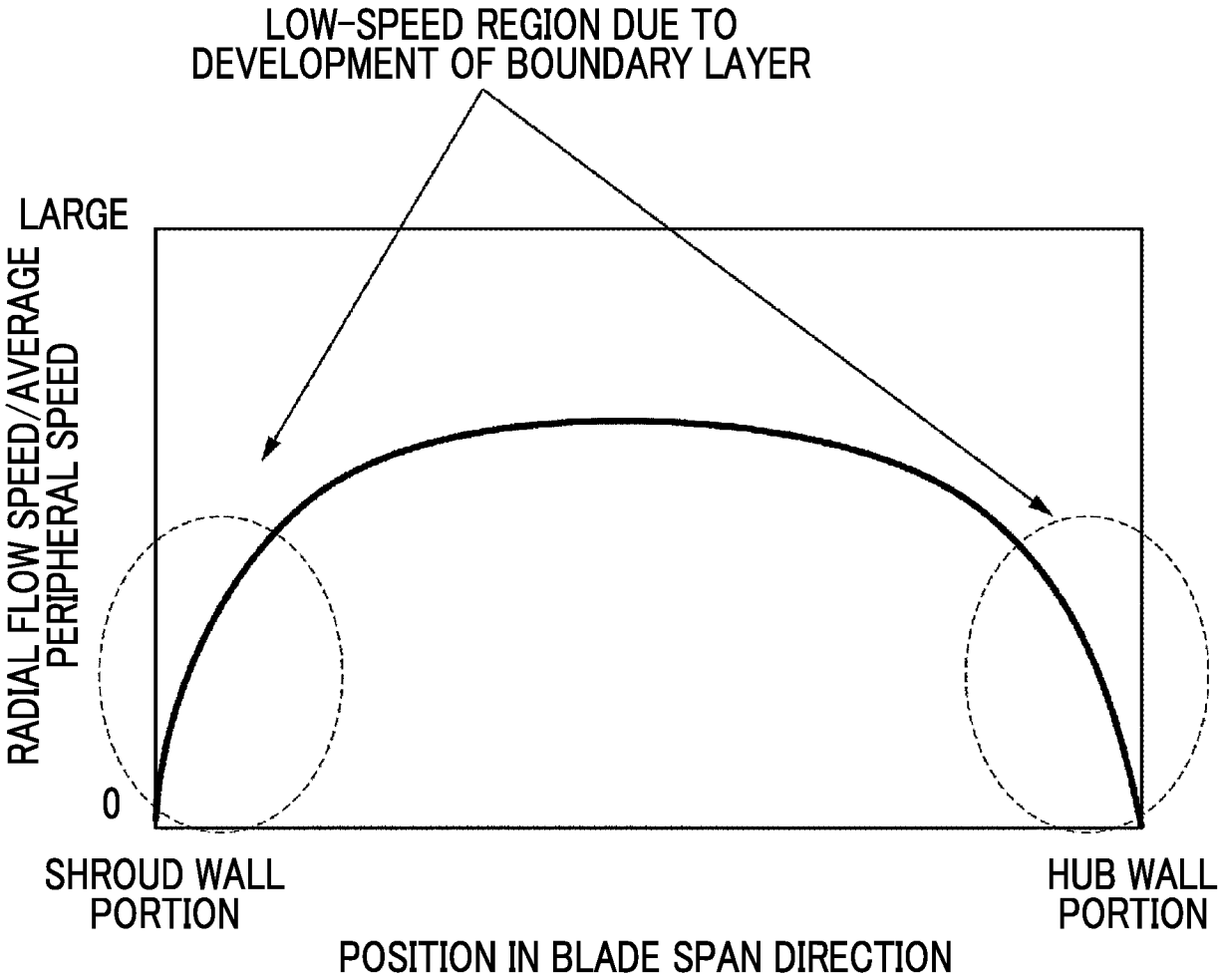
FIG. 13 is a diagram showing the radial flow speed distribution at the position of the evaluation cross section A in the comparative form.

FIG. 3 is a diagram showing the radial flow speed distribution at the position of an evaluation cross section A (refer to FIG. 2B) in FIG. 2B and the radial flow speed distribution at the position of the evaluation cross section A in a comparative form shown in FIG. 12. In FIG. 3, a horizontal axis represents a position in a blade span direction (in the illustrated example, a position in the axial direction) from a wall surface on the shroud wall portion 20 side to a wall surface on the hub wall portion 24 side), and a vertical axis represents the radial flow speed (more specifically, a dimensionless value obtained by dividing the radial flow speed by the average peripheral speed of the impeller 10 at the position of the outlet of the impeller 10).

As shown in FIG. 3, in the above embodiment, the trailing edge 30 of the blade 16 includes the first decrease section 30*a* and the first increase section 30*b* described above, and therefore, compared to the configuration shown in FIG. 12, the relative flow speed on the tip end 30*s* side (the shroud wall portion 20 side) of the trailing edge 30 with respect to the flow speed in an intermediate span region between the shroud wall portion 20 and the hub 14, and the relative flow speed on the base end 30*h* side (the hub wall portion 24 side) of the trailing edge 30 with respect to the flow speed in the intermediate span region can be increased. In this way, the radial flow speed at each position in the blade span direction is uniformized, so that bias of a flow in the blade span direction can be suppressed. Further, in a case of being considered at the same flow rate, the flow speed in the vicinity of the shroud wall portion 20 and the flow speed in the vicinity of the hub wall portion 24 are increased, so that the occurrence of the separation in the vicinity of the shroud wall portion d the separation in the vicinity of the hub wall portion 24 can be suppressed, and therefore, it is possible to suppress an increase in loss due to the separation and to reduce a risk of a reduction in operating range due to a stall. Therefore, the centrifugal compressor 4 with high efficiency and a wide operating range can be realized. Further, compared to a case where the outer diameter of the impeller 10 is uniformly expanded from the base end 30*h* to the tip end 30*s* of the trailing edge 30 of the blade 16, the weight of the impeller 10 can be reduced and an increase in centrifugal stress can be suppressed.

Further, as described using FIG. 2B, in the above embodiment, the minimum value Dm of the radial distance to the rotational axis line C in the first decrease section 30*a* and the first increase section 30*b* is smaller than the distance Dh between the base end 30*h* of the trailing edge 30 and the rotational axis line C, and therefore, compared to a case where the minimum value Dm of the radial distance to the rotational axis line C in the first decrease section 30*a* and the first increase section 30*b* is larger than the distance Dh between the base end 30*h* of the trailing edge 30 and the rotational axis line C, the weight of the impeller 10 can be reduced and the centrifugal stress occurring in the impeller 10 can be reduced.

Further, as described using FIG. 2B, in the above embodiment, since the minimum value Ya of the Y-coordinate of the first decrease section 30*a* has a negative value, it is possible to enhance the effect of uniformizing the radial flow speed at each position in the blade span direction.

Further, as described using FIG. 2B, in the above embodiment, by satisfying the relationship $0.2 \leq Xm/Xh \leq 0.8$, it is possible to enhance the effect of uniformizing the radial flow speed at each position in the blade span direction.

Figure 4A:
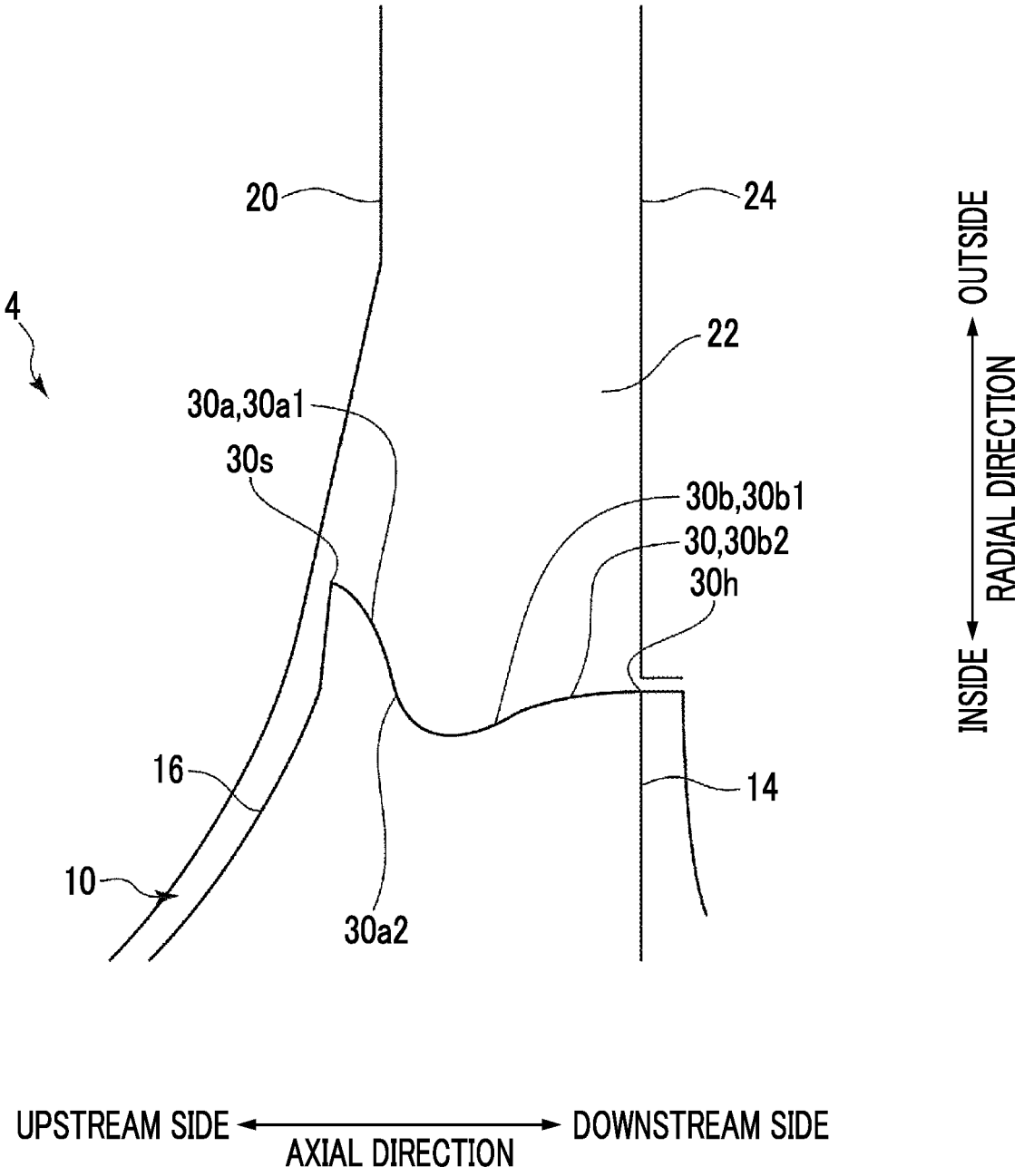
FIG. 4A is a meridian plane diagram showing another example of the meridian plane shape of the blade 16 with respect to the trailing edge 30 of the blade 16 of the impeller 10 in the turbocharger 2 shown in FIG. 1, and shows the vicinity of the outlet of the impeller 10 in the centrifugal compressor 4 of the turbocharger 2 in an enlarged manner.
Figure 4B:
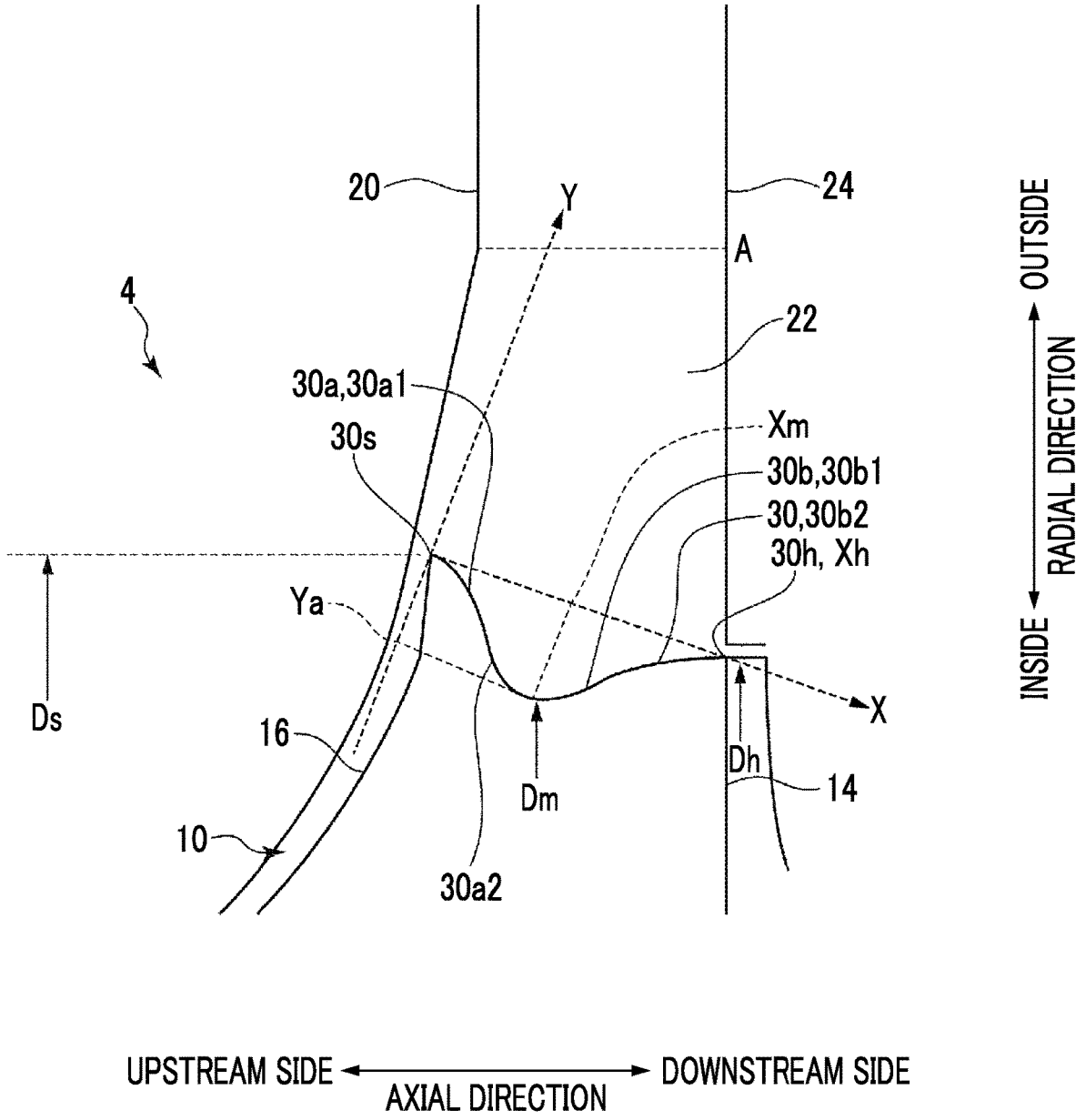
FIG. 4B is a diagram in which as coordinate axes, an X-axis and a Y-axis are shown in the configuration shown in FIG. 4A.

FIG. 4A is a meridian plane diagram schematically showing an example of the configuration of a portion in the vicinity of the outlet of the impeller 10 in the centrifugal compressor 4 of the turbocharger 2 shown in FIG. 1, and shows a part of the meridian plane shape of the blade 16 of the impeller 10. FIG. 4B is a diagram in which the coordinate axes and the like are added to the meridian plane diagram shown in FIG. 4A. The definitions of the X-axis and the Y-axis are the same as those described above using FIG. 2B.

Also in the centrifugal compressor 4 shown in FIG. 4B, in the meridian plane shape of the blade 16, the trailing edge 30 of the blade 16 includes the first decrease section 30*a* that extends such that a Y-coordinate decreases as an X-coordinate increases, and the first increase section 30*b* that is located between the first decrease section 30*a* and the base end 30*h* and that extends such that a Y-coordinate increases as an X-coordinate increases.

In the example shown in FIG. 4B, the first decrease section 30*a* and the first increase section 30*b* are adjacent to each other, one end of the first decrease section 30*a* is the tip end 30*s* of the trailing edge 30, the other end of the first decrease section 30*a* is connected to one end of the first increase section 30*b*, and the other end of the first increase section 30*b* is the base end 30*h* of the trailing edge 30. Further, in the meridian plane shape of the blade 16, the trailing edge 30 of the blade 16 has a concave shape that is concave inward in the radial direction with respect to the X-axis. In the XY coordinate system shown in FIG. 4B, the first decrease section 30*a* is formed in a curved line shape that includes a curved line 30*a*l convex upward and a curved line 30*a*2 convex downward, and the first increase section 30*b* is formed in a curved line shape that includes a curved line 30*b*1 convex downward and a curved line 30*b*2 convex upward. The illustrated trailing edge 30 includes the curved line 30*a*1, the curved line 30*a*2, the curved line 30*b*1, and the curved line 30*b*2 in sequence in the positive direction of the X-axis.

Further, in the example shown in FIG. 4B, the minimum value Dm of the radial distance to the rotational axis line C (refer to FIG. 1) in the first decrease section 30*a* and the first increase section 30*b* is smaller than the distance Dh between the base end 30*h* of the trailing edge 30 and the rotational axis line C. Further, the minimum value Dm of the radial distance to the rotational axis line C in the first decrease section 30*a* and the first increase section 30*b* corresponds to the minimum value of the radial distance between the first increase section 30*b* and the rotational axis line C, and corresponds to the minimum value of the radial distance between the trailing edge 30 and the rotational axis line C. The distance Dh between the base end 30*h* and the rotational axis line C corresponds to the maximum value of the outer diameter of the hub 14.

Further, in the example shown in FIG. 4B, when the X-coordinate of the base end 30*h* of the trailing edge 30 is Xh and the X-coordinate at which the distance to the rotational axis line C in the first decrease section 30*a* and the first increase section 30*b* becomes the minimum distance (in the illustrated example, the X-coordinate of the boundary between the first decrease section 30*a* and the first increase section 30*b*) is Xm, a relationship $0.2 \leq Xm/Xh \leq 0.8$ is satisfied.

Further, in the example shown in FIG. 4B, the minimum value Ya of the Y-coordinate of the first decrease section 30*a* has a negative value. Further, the Y-coordinate of the trailing edge 30 is 0 at each of the tip end 30*s* and the base end 30*h* of the trailing edge 30, and has a negative value in the range between the tip end 30*s* and the base end 30*h*.

Further, in the example shown in FIG. 4B, a distance Ds between the tip end 30*s* of the trailing edge 30 and the rotational axis line C of the impeller 10 is larger than the distance Dh between the base end 30*h* of the trailing edge 30 and the rotational axis line C. That is, the outer diameter of the impeller 10 at the position of the tip end 30*s* of the trailing edge 30 is larger than the outer diameter of the impeller 10 at the position of the base end 30*h* of the trailing edge 30.

Here, the effects exhibited by the configuration shown in FIGS. 4A and 4B will be described.

Figure 5:
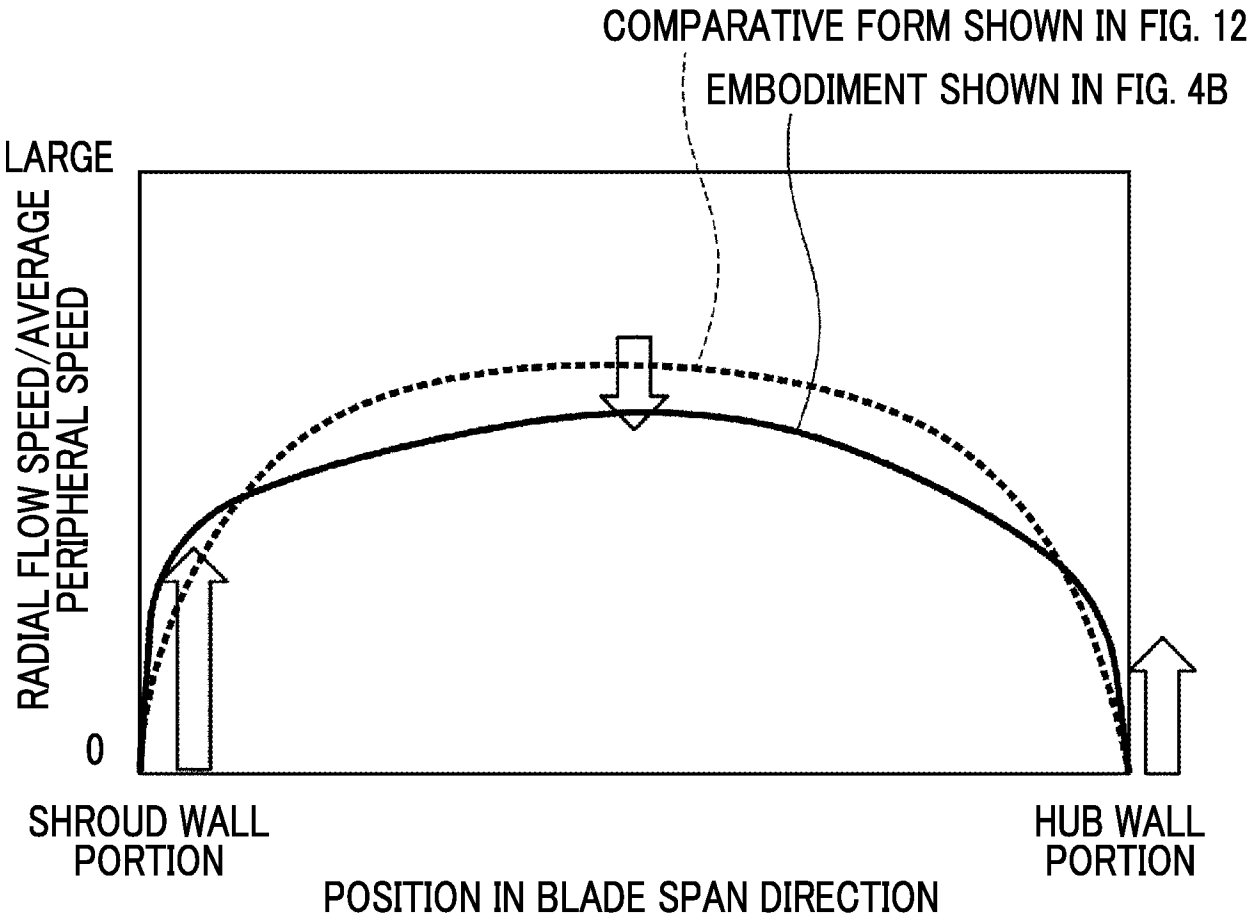
FIG. 5 is a diagram showing the radial flow speed distribution at the position of the evaluation cross section A in the embodiment shown in FIGS. 4A and 4B and the radial flow speed distribution at the position of the evaluation cross section A in the comparative form shown in FIG. 12.

FIG. 5 is a diagram showing the radial flow speed distribution at the position of the evaluation cross section A (refer to FIG. 4B) in the embodiment shown in FIGS. 4A and 4B and the radial flow speed distribution at the position of the evaluation cross section A in the comparative form shown in FIG. 12. In FIG. 5, the horizontal axis represents a position in the blade span direction from the wall surface on the shroud wall portion 20 side to the wall surface on the hub wall portion 24 side, and the vertical axis represents the radial flow speed (more specifically, a dimensionless value obtained by dividing the radial flow speed by the average peripheral speed of the impeller at the position of the outlet of the impeller 10).

As shown in FIG. 5, in the above embodiment, the trailing edge 30 of the blade 16 includes the first decrease section 30*a* and the first increase section 30*b* described above, and compared therefore, to the configuration shown in FIG. 12, the radial flow speed at each position in the blade span direction is uniformized, so that bias of a flow in the blade span direction can be suppressed. Further, in a case of being considered at the same flow rate, the flow speed in the vicinity of the shroud wall portion 20 and the flow speed in the vicinity of the hub wall portion 24 are increased, so that the occurrence of the separation in the vicinity of the shroud wall portion 20 and the separation in the vicinity of the hub wall portion 24 can be suppressed, and therefore, it is possible to suppress an increase in loss due to the separation and to reduce a risk of a reduction in operating range due to a stall. Therefore, the centrifugal compressor 4 with high efficiency and a wide operating range can be realized.

Figure 6:
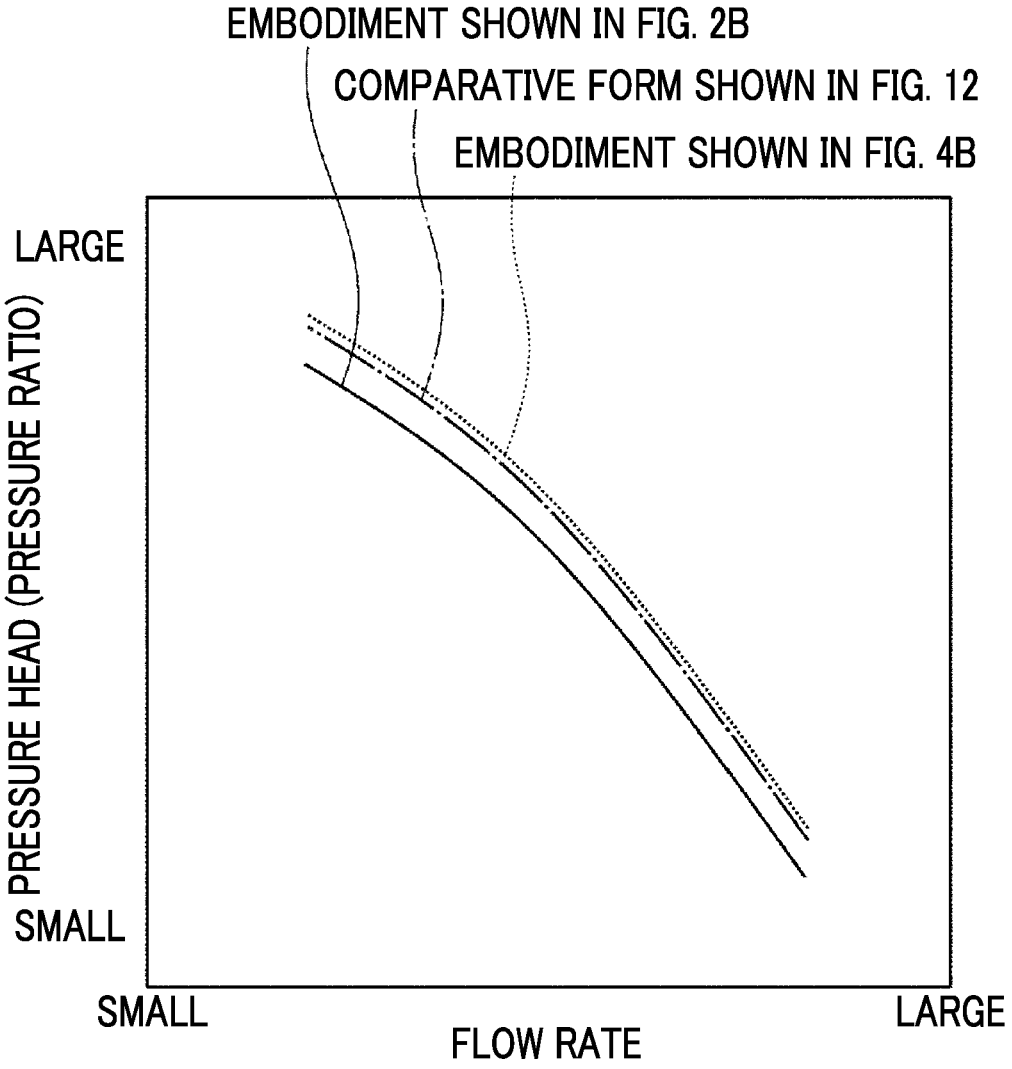
FIG. 6 is a diagram showing a relationship between a flow rate and pressure head with respect to the embodiment shown in FIG. 2B, the embodiment shown in FIG. 4B, and the comparative form shown in FIG. 12.

Further, as described using FIG. 4B, in the above embodiment, the distance Ds between the tip end 30*s* of the trailing edge 30 and the rotational axis line C of the impeller 10 is larger than the distance Dh between the base end 30*h* of the trailing edge 30 and the rotational axis line C, and therefore, by increasing the outer diameter of the impeller 10 at the position on the tip end 30*s* side (the shroud wall portion 20 side) of the trailing edge 30 while maintaining the maximum outer diameter of the hub 14 of the impeller 10, it is possible to increase the pressure head (pressure ratio) at the same rotation speed, as shown in FIG. 6. By increasing the outer diameter of the impeller 10 on the shroud wall portion 20 side, it is possible to increase the flow speed on the shroud wall portion 20 side, as shown in FIG. 5, and therefore, it is possible to effectively suppress a stall on the shroud wall portion 20 side.

Figure 7A:
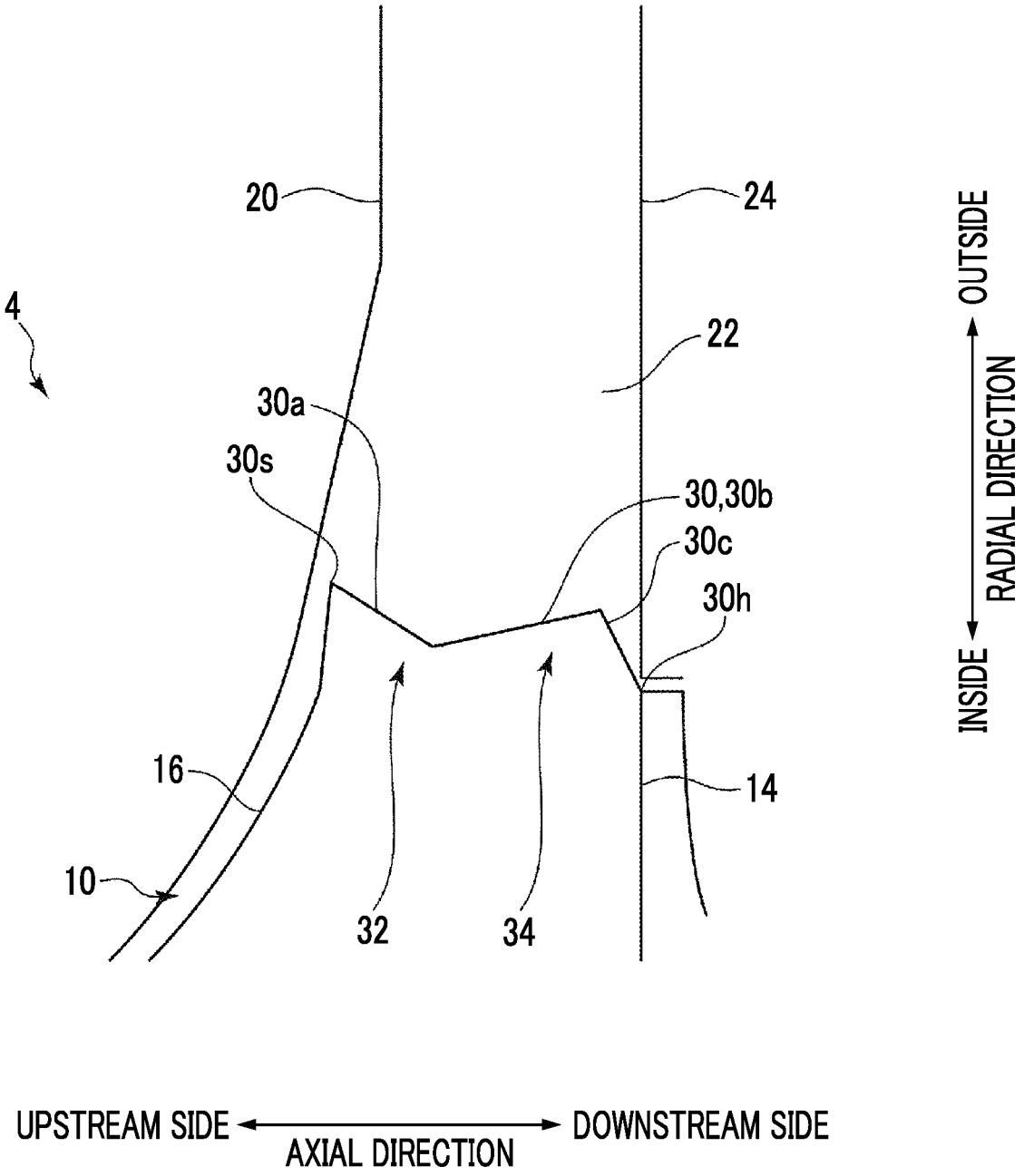
FIG. 7A is a meridian plane diagram showing another example of the meridian plane shape of the blade 16 with respect to the trailing edge 30 of the blade 16 of the impeller 10 in the turbocharger 2 shown in FIG. 1, and shows the vicinity of the outlet of the impeller 10 in the centrifugal compressor 4 of the turbocharger 2 in an enlarged manner.
Figure 7B:
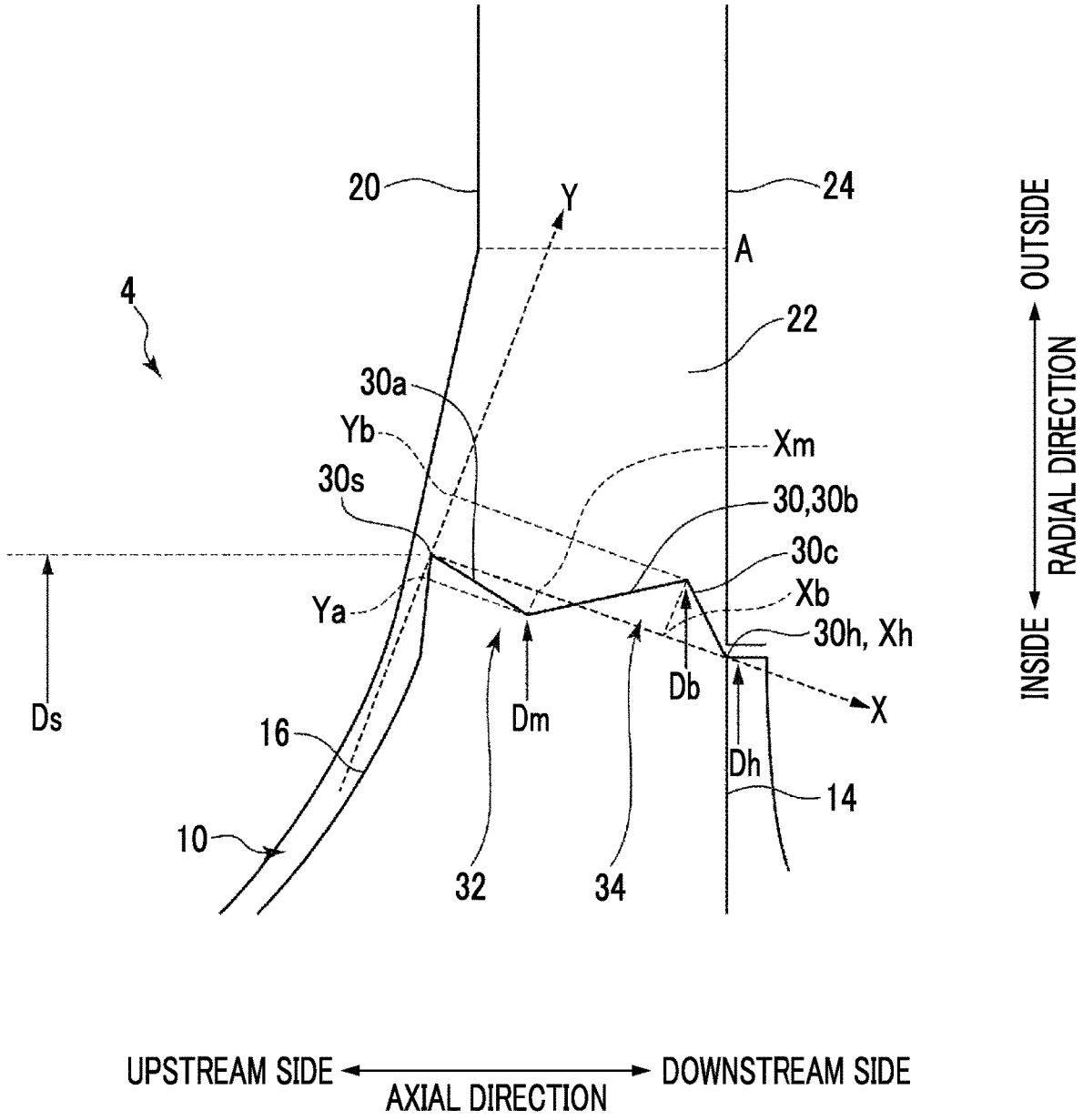
FIG. 7B is a diagram in which as coordinate axes, an X-axis and a Y-axis are shown in the configuration shown in FIG. 7A.

FIG. 7A is a meridian plane diagram schematically showing an example of the configuration of a portion in the vicinity of the outlet of the impeller 10 in the centrifugal compressor 4 of the turbocharger 2 shown in FIG. 1, and shows a part of the meridian plane shape of the blade 16 of the impeller 10. FIG. 7B is a diagram in which the coordinate axes and the like are added to the meridian plane diagram shown in FIG. 7A. The definitions of the X-axis and the Y-axis are the same as those described above using FIG. 2B.

In the centrifugal compressor 4 shown in FIG. 7B, in the meridian plane shape of the blade 16, the trailing edge 30 of the blade 16 includes the first decrease section 30*a* extends that such that a Y-coordinate decreases as an X-coordinate increases, the first increase section 30*b* that is located between the first decrease section 30*a* and the base end 30*h* and that extends such that a Y-coordinate increases as an X-coordinate increases, and a second decrease section 30*c* that is located between the first increase section 30*b* and the base end 30*h* and that extends such that a Y-coordinate decreases as an X-coordinate increases. The first decrease section 30*a* extends linearly in the negative direction of the Y-axis toward the positive direction of the X-axis. The first increase section 30*b* extends linearly in the positive direction of the Y-axis toward the positive direction of the X-axis. The second decrease section 30*c* extends linearly in the negative direction of the Y-axis toward the positive direction of the X-axis.

In the example shown in FIG. 7B, the first decrease section 30*a* and the first increase section 30*b* are adjacent to each other, and the first increase section 30*b* and the second decrease section 30*c* are adjacent to each other. One end of the first decrease section 30*a* is the tip end 30*s* of the trailing edge 30, and the other end of the first decrease section 30*a* is connected to one end of the first increase section 30*b*. The other end of the first increase section 30*b* is connected to one end of the second decrease section 30*c*, and the other end of the second decrease section 30*c* is the base end 30*h* of the trailing edge 30. Further, in the meridian plane shape of the blade 16, the trailing edge 30 of the blade 16 has a concave shape portion 32 that is concave in the negative direction of the Y-axis with respect to the X-axis, and a convex shape portion 34 that is located closer to the hub 14 side than the concave shape portion 32 is and that protrudes in the positive direction of the Y-axis with respect to the X-axis.

Further, in the example shown in FIG. 7B, the minimum value Dm of the radial distance to the rotational axis line C (refer to FIG. 1) in the first decrease section 30*a* and the first increase section 30*b* is larger than the distance Dh between the base end 30*h* of the trailing edge 30 and the rotational axis line C. Further, the minimum value Dm of the radial distance to the rotational axis line C in the first decrease section 30*a* and the first increase section 30*b* corresponds to the minimum value of the radial distance between the first increase section 30*b* and the rotational axis line C. The distance Dh between the base end 30*h* and the rotational axis line C corresponds to the maximum value of the outer diameter of the hub 14.

Further, in the example shown in FIG. 7B, when the X-coordinate of the base end 30*h* of the trailing edge 30 is Xh, the X-coordinate at which the distance to the rotational axis line C in the first decrease section 30*a* and the first increase section 30*b* becomes the minimum distance (in the illustrated example, the X-coordinate of the boundary between the first decrease section 30*a* and the first increase section 30*b*) is Xm, and the X-coordinate of the boundary between the first increase section 30*b* and the second decrease section 30*c* (the position where the Y-coordinate of the trailing edge 30 becomes the maximum value) is Xb, a relationship $0.5<Xb/Xh<1.0$ is satisfied, and relationships $0<Xm/Xh<0.5$ and $0.2\leq Xm/Xh\leq 0.8$ are satisfied.

Further, in the example shown in FIG. 7B, the minimum value Ya of the Y-coordinate of the first decrease section 30*a* has a negative value, and a maximum value Yb of the Y-coordinate of the first increase section 30*b* has a positive value.

Further, in the example shown in FIG. 7B, the distance Ds between the tip end 30*s* of the trailing edge 30 and the rotational axis line C of the impeller 10 is larger than the distance Dh between the base end 30*h* of the trailing edge 30 and the rotational axis line C, and a maximum value Db of the radial distance between the first increase section 30*b* and the rotational axis line C is larger than the distance Dh. That is, the outer diameter of the impeller 10 at the position of the tip end 30*s* of the trailing edge 30 is larger than the outer diameter of the impeller 10 at the position of the base end 30*h* of the trailing edge 30, and the outer diameter of the impeller 10 at the position of the boundary between the first increase section 30*b* and the second decrease section 30*c* is larger than the outer diameter of the impeller 10 at the position of the base end 30*h* of the trailing edge 30.

Here, the effects exhibited by the configuration shown in FIGS. 7A and 7B will be described.

Figure 8:
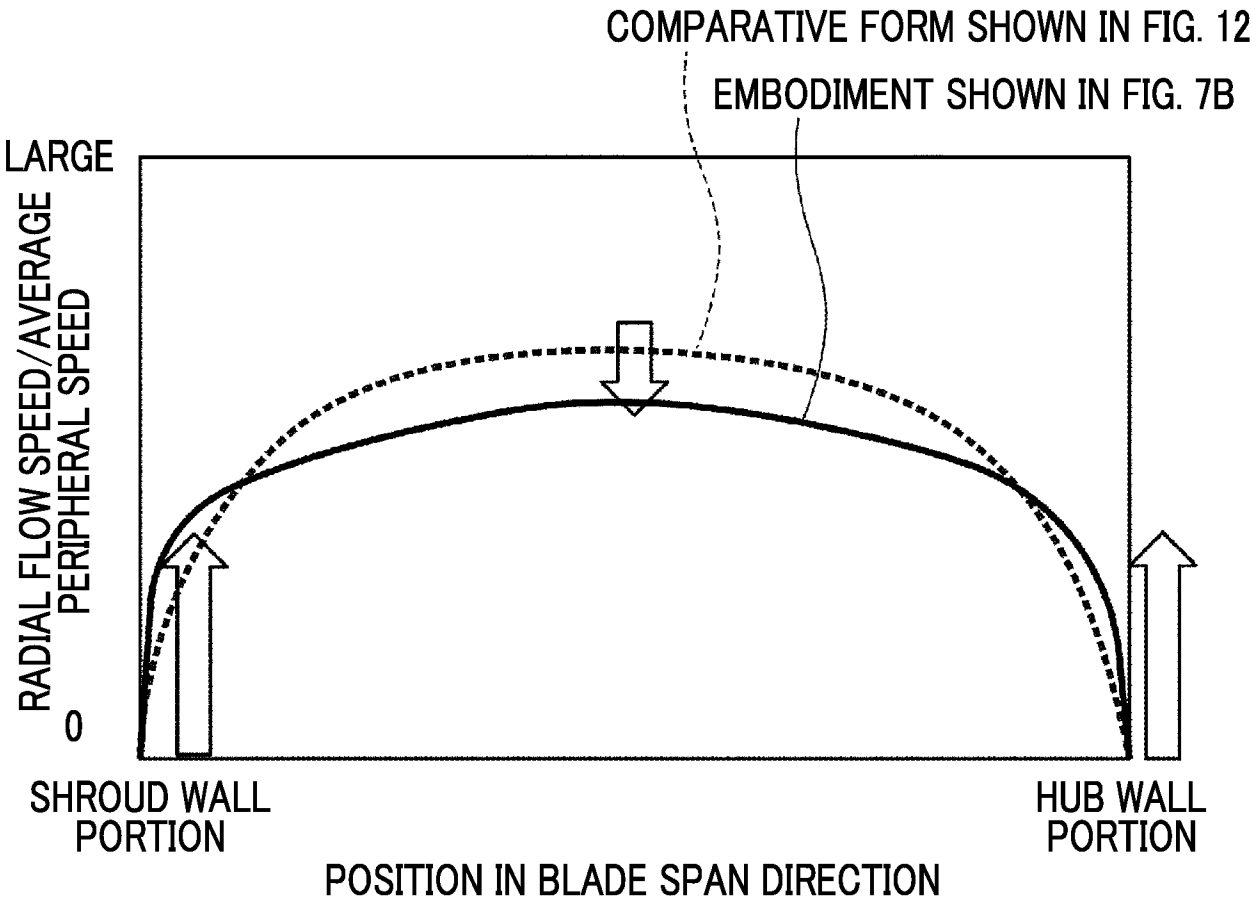
FIG. 8 is a diagram showing the radial flow speed distribution at the position of the evaluation cross section A in the embodiment shown in FIGS. 7A and 7B and the radial flow speed distribution at the position of the evaluation cross section A in the comparative form shown in FIG. 12.

FIG. 8 is a diagram showing the radial flow speed distribution at the position of the evaluation cross section A (refer to FIG. 7B) in the embodiment shown in FIGS. 7A and 7B and the radial flow speed distribution at the position of the evaluation cross section A in the comparative form shown in FIG. 12. In FIG. 8, the horizontal axis represents a position in the blade span direction from the wall surface on the shroud wall portion 20 side to the wall surface on the hub wall portion 24 side, and the vertical axis represents the radial flow speed (more specifically, a dimensionless value obtained by dividing the radial flow speed by the average peripheral speed of the impeller at the position of the outlet of the impeller 10).

As shown in FIG. 8, in the above embodiment, the trailing edge 30 of the blade 16 includes the first decrease section 30*a* and the first increase section 30*b* described above, and therefore, compared to the configuration shown in FIG. 12, the radial flow speed at each position in the blade span direction is uniformized, so that bias of a flow in the blade span direction can be suppressed. Further, in a case of being considered at the same flow rate, the flow speed in the vicinity of the shroud wall portion 20 and the flow speed in the vicinity of the hub wall portion 24 are increased, so that the occurrence of the separation in the vicinity of the shroud wall portion 20 and the separation in the vicinity of the hub wall portion 24 can be suppressed, and therefore, it is possible to suppress an increase in loss due to the separation and to reduce a risk of a reduction in operating range due to a stall. Therefore, the centrifugal compressor 4 with high efficiency and a wide operating range can be realized.

Further, as described using FIG. 7B, in the above embodiment, the distance Ds between the tip end 30*s* of the trailing edge 30 and the rotational axis line C of the impeller 10 is larger than the distance Dh between the base end 30*h* of the trailing edge 30 and the rotational axis line C, and the maximum value Db of the radial distance between the first increase section 30*b* and the rotational axis line C is larger than the distance Dh. Therefore, by increasing the outer diameter of the impeller 10 at the position on the tip end 30*s* side (the shroud wall portion 20 side) of the trailing edge 30 and the outer diameter of the impeller at the position on the base end 30*h* side (the hub wall portion 24 side) of the trailing edge 30 while maintaining the maximum outer diameter of the hub 14 of the impeller 10, it is possible to increase an average outer diameter of the impeller 10 and to increase the pressure head (pressure ratio) at the same rotation speed. Further, the flow speed is increased not only on the shroud wall portion 20 side but also on the hub wall portion 24 side, so that the radial flow speed at each position in the blade span direction can be more effectively uniformized.

Figure 9A:
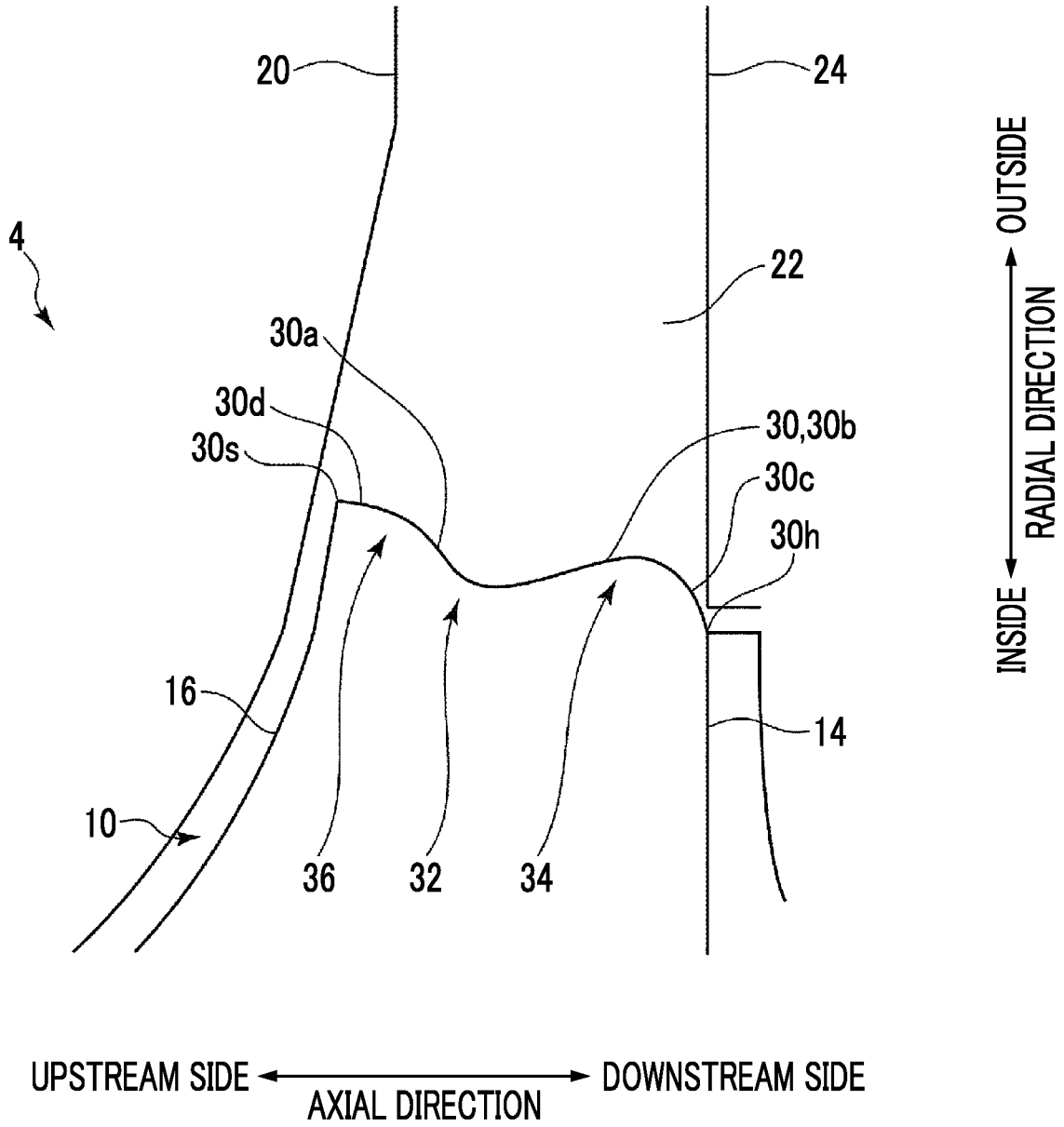
FIG. 9A is a meridian plane diagram showing another example of the meridian plane shape of the blade 16 with respect to the trailing edge 30 of the blade 16 of the impeller 10 in the turbocharger 2 shown in FIG. 1, and shows the vicinity of the outlet of the impeller 10 in the centrifugal compressor 4 of the turbocharger 2 in an enlarged manner.
Figure 9B:
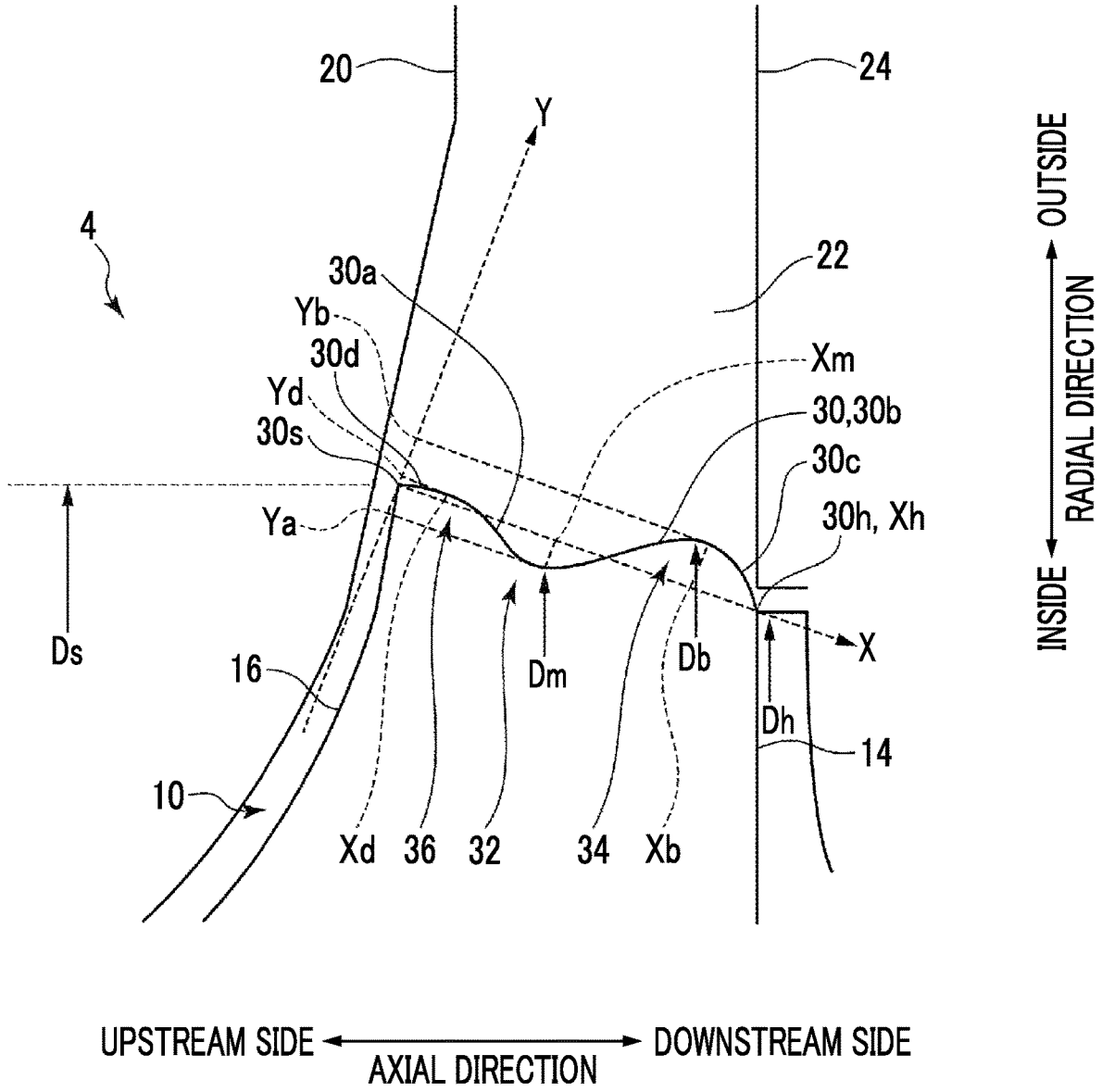
FIG. 9B is a diagram in which as coordinate axes, an X-axis and a Y-axis are shown in the configuration shown in FIG. 9A.

FIG. 9A is a meridian plane diagram showing another example of the meridian plane shape of the blade 16 with respect to the trailing edge 30 of the blade 16 of the impeller 10 in the turbocharger 2 shown in FIG. 1, and shows the vicinity of the outlet of the impeller 10 in the centrifugal compressor 4 of the turbocharger 2 in an enlarged manner. FIG. 9B is a diagram in which as coordinate axes, an X-axis and a Y-axis are shown in the configuration shown in FIG. 9A. The definitions of the X-axis and the Y-axis are the same as those described above using FIG. 2B.

In the centrifugal compressor 4 shown in FIG. 9B, in the meridian plane shape of the blade 16, the trailing edge 30 of the blade 16 includes the first decrease section 30*a* that extends such that a Y-coordinate decreases as an X-coordinate increases, the first increase section 30*b* that is located between the first decrease section 30*a* and the base end 30*h* and that extends such that a Y-coordinate increases as an X-coordinate increases, the second decrease section 30*c* that is located between the first increase section 30*b* and the base end 30*h* and that extends such that a Y-coordinate decreases as an X-coordinate increases, and a second increase section 30*d* that extends such that a Y-coordinate increases as an X-coordinate increases. The first decrease section 30*a* extends in the negative direction of the Y-axis toward the positive direction of the X-axis. The first increase section 30*b* extends in the positive direction of the Y-axis toward the positive direction of the X-axis. The second decrease section 30*c* extends in the negative direction of the Y-axis toward the positive direction of the X-axis. The second increase section 30*d* extends in the positive direction of the Y-axis toward the positive direction of the X-axis.

In the example shown in FIG. 9B, the second increase section 30*d* and the first decrease section 30*a* are adjacent to each other, the first decrease section 30*a* and the first increase section 30*b* are adjacent to each other, and the first increase section 30*b* and the second decrease section 30*c* are adjacent to each other. One end of the second increase section 30*d* is the tip end 30*s* of the trailing edge 30, and the other end of the second increase section 30*d* is connected to one end of the first decrease section 30*a*. The other end of the first decrease section 30*a* is connected to one end of the first increase section 30*b*, the other end of the first increase section 30*b* is connected to one end of the second decrease section 30*c*, and the other end of the second decrease section 30*c* is the base end 30*h* of the trailing edge 30. Further, in the meridian plane shape of the blade 16, the trailing edge 30 of the blade 16 has the concave shape portion 32 that is concave in the negative direction of the Y-axis with respect to the X-axis, the convex shape portion 34 that is located closer to the base end 30*h* side (the hub wall portion 24 side) than the concave shape portion 32 is and that protrudes outward in the positive direction of the Y-axis with respect to the X-axis, and a convex shape portion 36 that is located closer to the tip end 30*s* side (the shroud wall portion 20 side) than the concave shape portion 32 is and that protrudes in the positive direction of the Y-axis with respect to the X-axis. One end of the convex shape portion 36 is the tip end 30*s* of the trailing edge 30, the other end of the convex shape portion 36 is connected to one end of the concave shape portion 32, the other end of the concave shape portion 32 is connected to one end of the convex shape portion 34, and the other end of the convex shape portion 34 is the base end 30*h* of the trailing edge 30. In the XY coordinate system shown in FIG. 9B, the concave shape portion 32 includes a curved line that is convex downward, and each of the convex shape portions 34 and 36 includes a curved line that is convex upward.

Further, in the example e shown in FIG. 9B, the minimum value Dm of the radial distance to the rotational axis line C (refer to FIG. 1) in the first decrease section 30*a* and the first increase section 30*b* (in the illustrated example, the minimum value of the radial distance to the rotational axis line C in the first increase section 30*b*) is larger than the distance Dh between the base end 30*h* of the trailing edge 30 and the rotational axis line C. Further, the distance Ds between the tip end 30*s* of the trailing edge 30 and the rotational axis line C of the impeller 10 is larger than the distance Dh between the base end 30*h* of the trailing edge 30 and the rotational axis line C. Further, the maximum value Db of the radial distance between the first increase section 30*b* and the rotational axis line C is larger than the distance Dh. In the illustrated example, a relationship $Dh<Dm<Db<Ds$ is satisfied.

Figure 10:
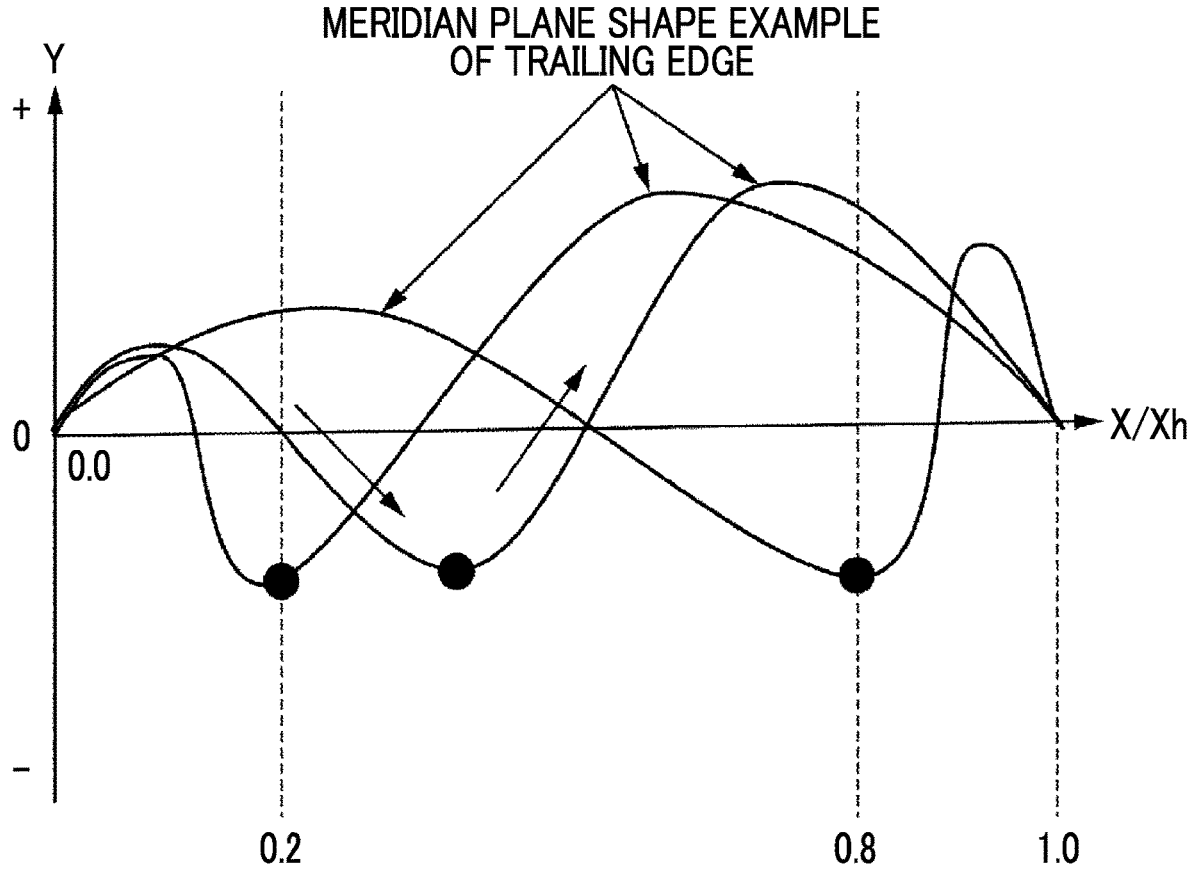
FIG. 10 is a diagram showing some examples of the meridian plane shape of the trailing edge 30 in an XY coordinate system.

Further, in the example shown in FIG. 9B, when the X-coordinate of the base end 30*h* of the trailing edge 30 is Xh, the X-coordinate at which the distance to the rotational axis line C in the first decrease section 30*a* and the first increase section 30*b* becomes the minimum distance is Xm, the X-coordinate of the boundary between the first increase section 30*b* and the second decrease section 30*c* (the position where the Y-coordinate of the trailing edge 30 becomes the maximum value) is Xb, and the X-coordinate of the boundary between the second increase section 30*d* and the first decrease section 30*a* is Xd, a relationship $0.5<Xb/Xh<1.0$ is satisfied, and a relationship $0<Xd/Xh<0.5$ is satisfied. Further, as in some examples of the meridian plane shape of the trailing edge 30 shown in FIG. 10, the trailing edge 30 may be formed so as to satisfy a relationship $0.2\leq Xm/Xh\leq 0.8$.

Further, in the example shown in FIG. 9B, the minimum value Ya of the Y-coordinate of the first decrease section 30*a* (that is, the minimum value of the Y-coordinate of the first increase section 30*b*) has a negative value, the maximum value Yb of the Y-coordinate of the first increase section 30*b* (the maximum value of the Y-coordinate of the second decrease section 30*c*) has a positive value, and the maximum value Yd of the Y-coordinate of the second increase section 30*d* (the maximum value of the Y-coordinate of the first decrease section 30*a*) has a positive value. In the illustrated example, a relationship $Ya<Yd<Yb$ is satisfied.

According to the centrifugal compressor 4 shown in FIG. 9B, similar to the configuration shown in FIG. 7B, the radial flow speed at each position in the blade span direction is uniformized, so that bias of a flow in the blade span direction can be suppressed. Therefore, it is possible to suppress an increase in loss due to separation, reduce a risk of a reduction in operating range due to a stall, and realize the centrifugal compressor 4 with high efficiency and a wide operating range. Further, the flow speed is increased not only on the shroud wall portion 20 side but also on the hub wall portion 24 side, so that the radial flow speed at each position in the blade span direction can be more effectively uniformized.

Figure 11:
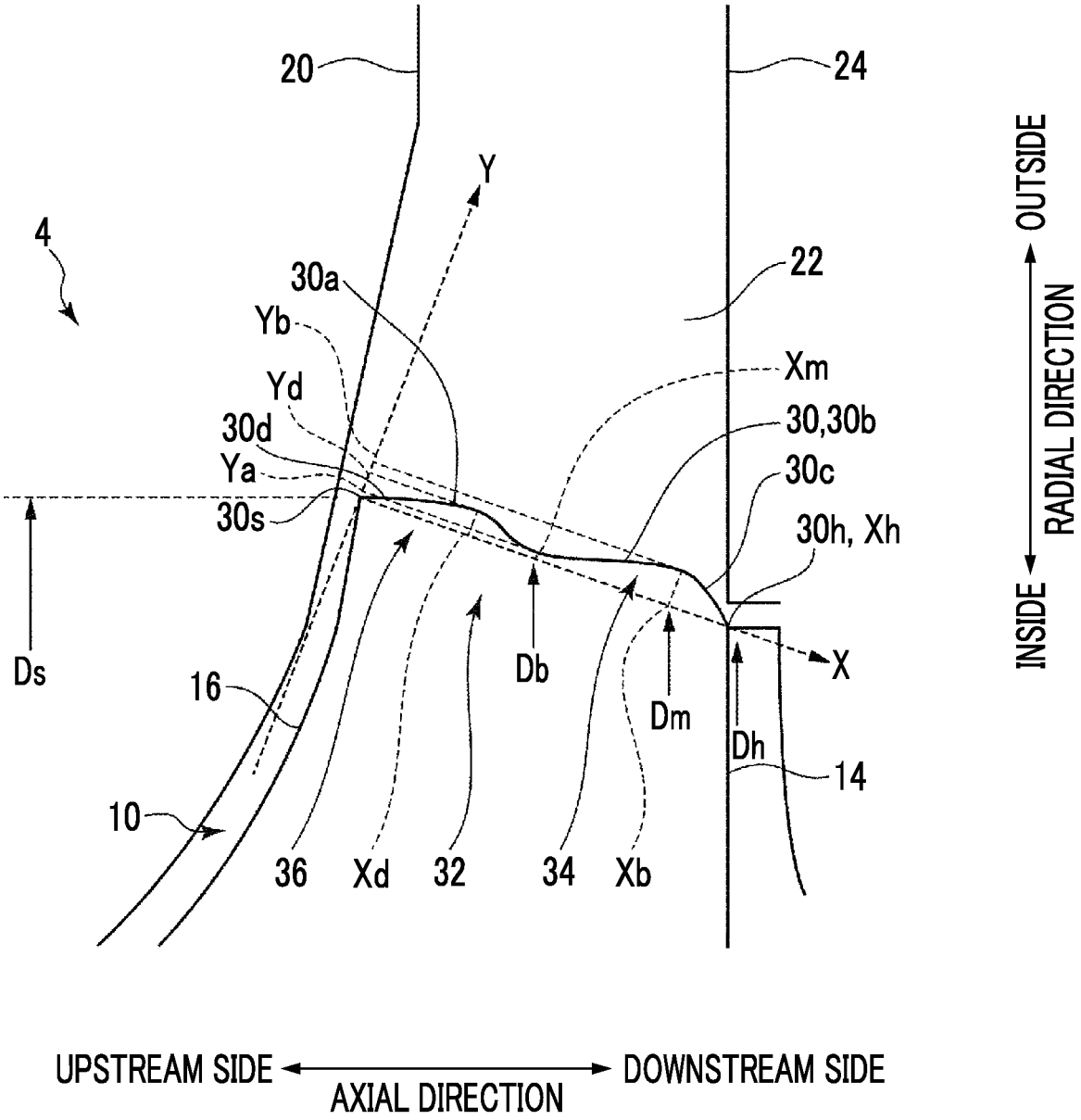
FIG. 11 is a meridian plane diagram showing another example of the meridian plane shape of the blade 16 with respect to the trailing edge 30 of the blade 16 of the impeller 10 in the turbocharger 2 shown in FIG. 1, and shows the vicinity of the outlet of the impeller 10 in the centrifugal compressor 4 of the turbocharger 2 in an enlarged manner.

FIG. 11 is a meridian plane diagram schematically showing an example of the configuration of a portion in the vicinity of the outlet of the impeller 10 in the centrifugal compressor 4 of the turbocharger 2 shown in FIG. 1, and shows a part of the meridian plane shape of the blade 16 of the impeller 10. The definitions of the X-axis and the Y-axis in the configuration shown in FIG. 11 are the same as those described above using FIG. 2B.

In the centrifugal compressor 4 shown in FIG. 11, in the meridian plane shape of the blade 16, the trailing edge 30 of the blade 16 includes the first decrease section 30*a* that extends such that a Y-coordinate decreases as an X-coordinate increases, the first increase section 30*b* that is located between the first decrease section 30*a* and the base end 30*h* and that extends such that a Y-coordinate increases as an X-coordinate increases, the second decrease section 30*c* that is located between the first increase section 30*b* and the base end 30*h* and that extends such that a Y-coordinate decreases as an X-coordinate increases, and the second increase section 30*d* that extends such that a Y-coordinate increases as an X-coordinate increases.

In the centrifugal compressor 4 shown in FIG. 11, unless otherwise specified, a reference sign common to that of each configuration of the centrifugal compressor 4 shown in FIGS. 9A and 9B denotes the same configuration as each configuration shown in FIGS. 9A and 9B, and description thereof is omitted.

In the example shown in FIG. 11, the minimum value Ya of the Y-coordinates of the first decrease section 30*a* (that is, the minimum value of the Y-coordinates of the first increase section 30*b*) has a value equal to or larger than 0, and satisfies Ya>0. That is, the trailing edge 30 is located outside the X-coordinate in the radial direction over the entire range except for the tip end 30*s* and the base end 30*h*. Further, the minimum value Dm of the radial distance to the rotational axis line C (refer to FIG. 1) in the first decrease section 30*a* and the first increase section 30*b* corresponds to the radial distance between the trailing edge 30 and the rotational axis line C at the boundary between the first increase section 30*b* and the second decrease section 30*c*.

According to the configuration shown in FIG. 11, similar to the configuration shown in FIG. 9B, the radial flow speed at each position in the blade span direction is uniformized, so that bias of a flow in the blade span direction can be suppressed. Therefore, it is possible to suppress an increase in loss due to separation, reduce a risk of a reduction in operating range due to a stall, and realize the centrifugal compressor 4 with high efficiency and a wide operating range. Further, the flow speed is increased not only on the shroud wall portion 20 side but also on the hub wall portion 24 side, so that the radial flow speed at each position in the blade span direction can be more effectively uniformized. Further, the minimum value Ya of the Y-coordinate of the first decrease section 30*a* has a value equal to or larger than 0, and therefore, compared to the case of Ya<0, the flow speed can be increased and the pressure head can be increased.

The present disclosure not limited to the embodiments described above, and includes modified forms of the embodiments described above or forms in which these forms are combined as appropriate.

For example, in some embodiments described above, the first decrease section 30*a* and the first increase section 30*b* are adjacent to each other. However, the first decrease section 30*a* and the first increase section 30*b* do not need to be adjacent to each other, and, for example, a section whose Y-coordinate is constant may be provided between the first decrease section 30*a* and the first increase section 30*b*.

The contents described in each of the embodiments described above are understood as follows, for example.

(1) An impeller (for example, the impeller 10 described above) of a centrifugal compressor (for example, the centrifugal compressor 4 described above) according to at least one embodiment of the present disclosure includes:

a hub (for example, the hub 14 described above); and a plurality of blades (for example, the blades 16 described above) provided at intervals in a circumferential direction of the impeller on an outer peripheral surface of the hub, in which, in a meridian plane shape of the blade, when an X-axis connecting a tip end (for example, the tip end 30*s* described above) and a base end (for example, the base end 30*h* described above) of a trailing edge (for example, the trailing edge 30 described above) and a Y-axis orthogonal to the X-axis are defined as coordinate axes with the tip end of the trailing edge of the blade as an origin, a direction from the tip end toward the base end along the X-axis is defined as a positive direction of the X-axis, and a direction toward an outside in a radial direction of the impeller along the Y-axis is defined as a positive direction of the Y-axis, the trailing edge in the meridian plane shape of the blade includes a first decrease section (for example, the first decrease section 30*a* described above) that extends such that a Y-coordinate decreases as an X-coordinate increases, and a first t increase section (for example, the first increase section 30*b* described above) that is located between the first decrease section and the base end and that extends such that a Y-coordinate increases as an X-coordinate increases.

According to the impeller of a centrifugal compressor according to the above (1), since the trailing edge of the blade includes the first decrease section and the first increase section, the relative flow speed on the tip end side (the shroud wall portion side) of the trailing edge with respect to the flow speed in the intermediate span region between the shroud wall portion facing the tip end of the blade and the hub, and the relative flow speed on the base end side (the hub wall portion side) of the trailing edge with respect to the flow speed in the intermediate span region can be increased. In this way, the radial flow speed at each position in the blade span direction is uniformized, so that bias of a flow in the blade span direction can be suppressed. Further, in a case of being considered at the same flow rate, the flow speed in the vicinity of the shroud wall portion and the flow speed in the vicinity of the hub wall portion are increased, so that the occurrence of the separation in the vicinity of the shroud wall portion and the separation in the vicinity of the hub wall portion can be suppressed, and therefore, it is possible to suppress an increase in loss due to the separation and to reduce a risk of a reduction in operating range due to a stall. Therefore, a centrifugal compressor with high efficiency and a wide operating range can be realized. Further, compared to a case where the outer diameter of the impeller is uniformly expanded from the base end to the tip end of the trailing edge of the blade, the weight of the impeller can be reduced and an increase in centrifugal stress can be suppressed.

(2) In some embodiments, in the impeller of a centrifugal compressor according to the above (1), the first decrease section and the first increase section are adjacent to each other.

According to the impeller of a centrifugal compressor according to (2), a centrifugal compressor with high efficiency can be realized.

(3) In some embodiments, in the impeller of a centrifugal compressor according to the above (1) or (2), a distance between the tip end of the trailing edge and a rotational axis line of the impeller is larger than a distance between the base end of the trailing edge and the rotational axis line.

According to the impeller of a centrifugal compressor according to the above (3), by increasing the outer diameter of the impeller at the position on the tip end side (the shroud wall portion side) of the trailing edge while maintaining the maximum outer diameter of the hub of the impeller, it is possible to increase the pressure head (pressure ratio) at the same rotation speed. Further, by increasing the outer diameter of the impeller on the shroud wall portion side, it is possible to increase the flow speed on the shroud wall portion side, and therefore, it is possible to effectively suppress a stall on the shroud wall portion side.

(4) In some embodiments, in the impeller of a centrifugal compressor according to any one of the above (1) to (3), the trailing edge includes a second decrease section (for example, the second decrease section 30*c* described above) that extends such that a Y-coordinate decreases as an X-coordinate increases, between the first increase section and the base end.

According to the impeller of a centrifugal compressor r according to the above (4), a convex shape portion (for example, the convex shape portion 34 described above) that protrudes in the positive direction of the Y-axis with respect to the X-axis can be formed on the hub side of the trailing edge. In this way, the flow speed in the vicinity of the hub wall portion is increased, so that the radial flow speed at each position in the blade span direction can be more effectively uniformized.

(5) In some embodiments, in the impeller of a centrifugal compressor according to any one of the above (1) to (4), the trailing edge includes, on a hub side of the trailing edge, a convex shape portion that protrudes in the positive direction of the Y-axis with respect to the X-axis.

According to the impeller of a centrifugal compressor according to the above (5), the flow speed in the vicinity of the hub wall portion is increased, so that the radial flow speed at each position in the blade span direction can be more effectively uniformized.

(6) In some embodiments, in the impeller of a centrifugal compressor according to any one of the above (1) to (5), a minimum value of a radial distance to a rotational axis line in the first decrease section and the first increase section is larger than a distance between the base end and the rotational axis line.

According to the impeller of a centrifugal compressor according to the above (6), the average flow speed at the outlet of the impeller can be increased compared to a case where the minimum value of the radial distance to the rotational axis line in the first decrease section and the first increase section is smaller than the distance between the base end of the trailing edge and the rotational axis line.

(7) In some embodiments, in the impeller of a centrifugal compressor according to any one of the above (1) to (5), a minimum value of a radial distance to a rotational axis line in the first decrease section and the first increase section is smaller than a distance between the base end and the rotational axis line.

According to the impeller of a centrifugal compressor according to the above (7), compared to a case where the minimum value of the radial distance to the rotational axis line in the first decrease section and the first increase section is larger than the distance between the base end of the trailing edge and the rotational axis line, the weight of the impeller 10 is reduced, so that centrifugal stress that occurs in the impeller can be reduced.

(8) In some embodiments, in the impeller of a centrifugal compressor according to any one of the above (1) to (7), a minimum value of a Y-coordinate of the first decrease section has a negative value.

According to the impeller of a centrifugal compressor according to the above (8), it is possible to enhance the effect of uniformizing the radial flow speed at each position in the blade span direction.

(9) In some embodiments, in the impeller of a centrifugal compressor according to any one of the above (1) to (6), a minimum value of a Y-coordinate of the first decrease section has a value equal to or larger than 0.

According to the impeller of a centrifugal compressor according to the above (9), compared to a case where the minimum value of the Y-coordinate of the first decrease section is smaller than 0, the flow speed can be increased and the pressure head can be increased.

(10) In some embodiments, in the impeller of a centrifugal compressor according to any one of the above (1) to (9), each of the first decrease section and the first increase section is linearly formed.

According to the impeller of a centrifugal compressor according to the above (10), manufacture of the impeller can be facilitated.

(11) In some embodiments, in the impeller of a centrifugal compressor according to any one of the above (1) to (9), each of the first decrease section and the first increase section is formed in a curved line shape.

According to the impeller of a centrifugal compressor according to the above (11), concentration of centrifugal stress in the impeller can be suppressed.

(12) In some embodiments, in the impeller of a centrifugal compressor according to any one of the above (1) to (11), the trailing edge includes a second increase section that extends such that a Y-coordinate increases as an X-coordinate increases, between the tip end and the first decrease section.

According to the impeller of a centrifugal compressor according to the above (12), a convex shape portion (for example, the convex shape portion 36 described above) that protrudes in the positive direction of the Y-axis with respect to the X-axis can be formed on the shroud wall portion of the trailing edge. In this way, the flow speed in the vicinity of the shroud wall portion is increased, so that the radial flow speed at each position in the blade span direction be more effectively uniformized.

(13) In some embodiments, in the impeller of a centrifugal compressor according to any one of the above (1) to (12), the trailing edge includes, on a tip end side of the trailing edge, a convex shape portion that protrudes in the positive direction of the Y-axis with respect to the X-axis.

According to the impeller of a centrifugal compressor according to the above (13), the flow speed in the vicinity of the shroud wall portion is increased, so that the radial flow speed at each position in the blade span direction can be more effectively uniformized.

(14) In some embodiments, in the impeller of a centrifugal compressor according to any one of the above (1) to (13), the first decrease section and the first increase section are adjacent to each other, and when an X-coordinate of the base end of the trailing edge is Xh, and an X-coordinate at which a distance to a rotational axis line in the first decrease section and the first increase section becomes a minimum distance is Xm, a relationship $0.2 \leq Xm/Xh \leq 0.8$ is satisfied.

According to the impeller of a centrifugal compressor according to the above (14), it is possible to enhance the effect of uniformizing the radial flow speed at each position in the blade span direction.

(15) A centrifugal compressor according to at least one embodiment of the present disclosure includes:

the impeller of a centrifugal compressor according to any one of the above (1) to (14); and a casing that accommodates the impeller.

According to the centrifugal compressor according to the above (15), since it includes the impeller described in any one of the above (1) to (14), it is possible to realize a centrifugal compressor with high efficiency and a wide operating range.

REFERENCE SIGNS LIST

2: turbocharger
4: centrifugal compressor
6: rotary shaft
8: turbine
9: turbine wheel
10: impeller
12: casing
14: hub
16: blade
16*s*: tip end
18: air flow path
20: shroud wall portion
22: diffuser flow path
24: hub wall portion
26: scroll flow path
28: scroll part
29: leading edge
30: trailing edge
30*a*: first decrease section
30*b*: first increase section
30*c*: second decrease section
30*d*: second increase section
30*a*1, 30*a*2, 30*b*1, 30*b*2: curved line
30*h*: base end
30*s*: tip end
32: concave shape portion
34, 36: convex shape portion

The invention claimed is:

1. An impeller of a centrifugal compressor, the impeller surrounded by a shroud wall portion of a casing in a circumferential direction of the impeller, comprising:

a hub; and a plurality of blades provided at intervals in the circumferential direction of the impeller on an outer peripheral surface of the hub, wherein each of the plurality of blades connects a leading edge of the blade and a trailing edge of the blade, and includes a tip end facing the shroud wall portion, wherein a gap is formed between the shroud wall and the tip end of the blade in which a part of a fluid compressed by the impeller is capable of flowing through wherein, in a meridian plane shape of the blade, when an X-axis connecting the tip end and a base end of the trailing edge and a Y-axis orthogonal to the X-axis are defined as coordinate axes with the tip end of the trailing edge as an origin, a direction from the tip end toward the base end along the X-axis is defined as a positive direction of the X-axis, and a direction toward an outside in a radial direction of the impeller along the Y-axis is defined as a positive direction of the Y-axis, the trailing edge in the meridian plane shape of the blade includes a first decrease section that extends such that a Y-coordinate decreases as an X-coordinate increases, and a first increase section that is located between the first decrease section and the base end and that extends such that a Y-coordinate increases as an X-coordinate increases.

2. The impeller of a centrifugal compressor according to claim 1, wherein the first decrease section and the first increase section are adjacent to each other.

3. The impeller of a centrifugal compressor according to claim 1, wherein a distance between the tip end of the trailing edge and a rotational axis line of the impeller is larger than a distance between the base end of the trailing edge and the rotational axis line.

4. The impeller of a centrifugal compressor according to claim 1, wherein the trailing edge includes a second decrease section that extends such that a Y- coordinate decreases as an X-coordinate increases, between the first increase section and the base end.

5. The impeller of a centrifugal compressor according to claim 1, wherein the trailing edge includes, on a hub side of the trailing edge, a convex shape portion that protrudes in the positive direction of the Y-axis with respect to the X-axis.

6. The impeller of a centrifugal compressor according to claim 1, wherein a minimum value of a radial distance to a rotational axis line of the impeller in the first decrease section and the first increase section is larger than a distance between the base end and the rotational axis line.

7. The impeller of a centrifugal compressor according to claim 1, wherein a minimum value of a radial distance to a rotational axis line of the impeller in the first decrease section and the first increase section is smaller than a distance between the base end and the rotational axis line.

8. The impeller of a centrifugal compressor according to claim 1, wherein a minimum value of a Y-coordinate of the first decrease section has a negative value.

9. The impeller of a centrifugal compressor according to claim 1, wherein a minimum value of a Y-coordinate of the first decrease section has a value equal to or larger than 0.

10. The impeller of a centrifugal compressor according to claim 1, wherein each of the first decrease section and the first increase section is linearly formed.

11. The impeller of a centrifugal compressor according to claim 1, wherein each of the first decrease section and the first increase section is formed in a curved line shape.

12. The impeller of a centrifugal compressor according to claim 1, wherein the trailing edge includes a second increase section that extends such that a Y-coordinate increases as an X-coordinate increases, between the tip end and the first decrease section.

13. The impeller of a centrifugal compressor according to claim 1, wherein the trailing edge includes, on a tip end side of the trailing edge, a convex shape portion that protrudes in the positive direction of the Y-axis with respect to the X-axis.

14. The impeller of a centrifugal compressor according to Claim 1, wherein the first decrease section and the first increase section are adjacent to each other, and when an X-coordinate of the base end of the trailing edge is Xh, and an X-coordinate at which a distance to a rotational axis line of the impeller in the first decrease section and the first increase section becomes a minimum distance is Xm, a relationship $0.2 \leq Xm/Xh \leq 0.8$ is satisfied.

15. A centrifugal compressor comprising:

the impeller of a centrifugal compressor according to claim 1; and a casing that accommodates the impeller.

* * * * *